US006559421B1

(12) United States Patent
Yura et al.

(10) Patent No.: US 6,559,421 B1
(45) Date of Patent: May 6, 2003

(54) IMAGE FORMING APPARATUS AND FIXING DEVICE THEREFOR

(75) Inventors: Jun Yura, Kanagawa (JP); Takashi Fujita, Saitama (JP); Hirokazu Ikenoue, Tokyo (JP); Atsushi Nakafuji, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/698,035

(22) Filed: Oct. 30, 2000

(30) Foreign Application Priority Data

| | | |
|---|---|---|
| Oct. 29, 1999 | (JP) | 11-308754 |
| Mar. 31, 2000 | (JP) | 2000-098505 |
| Mar. 31, 2000 | (JP) | 2000-098547 |
| Aug. 25, 2000 | (JP) | 2000-255593 |

(51) Int. Cl.[7] ..... G03G 15/20; H05B 3/44
(52) U.S. Cl. ..... 219/216; 399/330
(58) Field of Search ..... 219/216, 538, 219/540, 546, 548; 392/407, 408, 418; 399/330, 336; 362/293, 311, 267; 313/637, 643

(56) References Cited

U.S. PATENT DOCUMENTS

| | | | | |
|---|---|---|---|---|
| 4,355,225 A | * | 10/1982 | Marsh | 219/216 |
| 4,653,897 A | * | 3/1987 | Fromm | 219/216 |
| 4,668,869 A | * | 5/1987 | Matosian et al. | 250/504 R |
| 5,115,119 A | * | 5/1992 | Adachi et al. | 219/469 |
| 5,207,503 A | * | 5/1993 | McLaughlin | 313/643 |
| 5,436,431 A | * | 7/1995 | Tsuji et al. | 219/216 |
| 5,708,949 A | | 1/1998 | Kasahara et al. | |
| 5,748,837 A | * | 5/1998 | Lokar et al. | 392/407 |
| 5,854,465 A | | 12/1998 | Kishi et al. | |
| 6,108,906 A | | 8/2000 | Fujita et al. | |
| 6,122,479 A | | 9/2000 | Fujita et al. | |
| 6,144,832 A | | 11/2000 | Nimura et al. | |
| 6,243,559 B1 | * | 6/2001 | Kurotaka et al. | 399/329 |
| 2002/0011475 A1 | * | 1/2002 | Haneda et al. | 219/216 |

FOREIGN PATENT DOCUMENTS

| | | |
|---|---|---|
| JP | 49-119828 | 10/1974 |
| JP | 55-151339 | 11/1980 |
| JP | 59-092924 | 5/1984 |
| JP | 3-026164 | 2/1991 |
| JP | 3-221984 | 9/1991 |
| JP | 5-142964 | 6/1993 |
| JP | 7-121041 | 5/1995 |
| JP | 7-254393 | 10/1995 |
| JP | 7-296949 | 11/1995 |
| JP | 9-54516 | 2/1997 |
| JP | 9-135776 | 5/1997 |
| JP | 9-265246 | 10/1997 |
| JP | 9-319240 | * 12/1997 |
| JP | 10-325601 | 12/1998 |
| JP | 11-174899 | 7/1999 |
| JP | 2000-321900 | * 11/2000 |
| JP | 2001-035639 | 2/2001 |

* cited by examiner

*Primary Examiner*—Joseph Pelham
(74) *Attorney, Agent, or Firm*—Oblon, Spivak, McClelland, Maier & Neustadt, P.C.

(57) ABSTRACT

A fixing device for forming a toner image formed on a recording medium includes a heat roller accommodating a halogen heater. The halogen heater includes a glass tube formed of transparent quartz and provided with a wall thickness of 0.8 mm or below to increase transmission thereof. The increased transmission reduces a heat loss ascribable to the glass tube at the time of warm-up of the fixing device. The heat roller has such a thermal capacity that it can be warmed up in 10 seconds or loss. The glass tube is filled with inactive gas whose major component is krypton or xenon. A tungsten filament accommodated in the glass tube has its diameter reduced in order to implement a color temperature of 2,500 K or above. An image forming apparatus using the fixing device is also disclosed.

17 Claims, 28 Drawing Sheets

*Fig. 13*

| | ① | ② | ③ | ④ |
|---|---|---|---|---|
| HEAT ROLLER | φ30 Fe t=0.85 | φ30 Fe t=0.85 | φ30 Fe t=0.4 | φ30 Fe t=0.4 |
| HEATER | 80% TRANSMISSION | 94% TRANSMISSION | 80% TRANSMISSION | 94% TRANSMISSION |
| ELEVATION TIME TO SET 180℃ | 20.8 | 17.9 | 9.6 | 8.3 |
| SET STAND-BY TEMPERATURE FOR 5 Sec. RECOVERY TIME | 153 | 146 | 107 | 90 |
| DIFFERENCE IN SET TIME (①vs.② AND ③vs. ④) | – | 7 | – | 17 |
| POWER CONSUMPTION AT STAND-BY STATE (Wh) | 108 | 98 | 52 | 38 |
| REDUCTION OF POWER CONSUMPTION (①vs.② AND ③vs. ④) | 0.0% | 9.3% | 0.0% | 26.9% |

*Fig. 20*

| EXPERI-MENT | GAS | COLOR TEMPERATURE (K) | WARM-UP TIME (Sec) | CONTINUOUS TURN-ON LIFE (HOURS) | HEAT CYCLE DURABILITY (TIMES; ON FOR 0.5 Sec & OFF FOR 10 Sec) |
|---|---|---|---|---|---|
| 1 | Ar | 2400 | 11.0 | NO BREAKAGE IN 3,000 HOURS | NO BREAKAGE IN 100,000 TIMES |
| 2 | 〃 | 2500 | 10.3 | 2300 | 40000 |
| 3 | 〃 | 2600 | 10.2 | 1200 | 20000 |
| 4 | Kr | 2400 | 9.9 | NO BREAKAGE IN 3,000 HOURS | NO BREAKAGE IN 100,000 TIMES |
| 5 | 〃 | 2500 | 9.5 | NO BREAKAGE IN 3,000 HOURS | 50000 |
| 6 | 〃 | 2600 | 9.4 | NO BREAKAGE IN 3,000 HOURS | 30000 |
| 7 | Xe | 2400 | 9.8 | NO BREAKAGE IN 3,000 HOURS | NO BREAKAGE IN 100,000 TIMES |
| 8 | 〃 | 2500 | 9.3 | NO BREAKAGE IN 3,000 HOURS | 50000 |
| 9 | 〃 | 2600 | 9.0 | NO BREAKAGE IN 3,000 HOURS | 30000 |

*Fig. 21*

| EXPERI-MENT | GAS | COLOR TEMPERATURE (K) | ELEVATION TIME (Sec) |
|---|---|---|---|
| 1 | Ar | 2400 | 11.0 |
| 2 | 〃 | 2600 | 10.3 |
| 3 | 〃 | 2800 | 10.2 |
| 4 | Kr | 2400 | 9.9 |
| 5 | 〃 | 2600 | 9.5 |
| 6 | 〃 | 2800 | 9.4 |
| 7 | Xe | 2400 | 9.8 |
| 8 | 〃 | 2600 | 9.3 |
| 9 | 〃 | 2800 | 9.0 |

Fig. 25

| EXPERI-MENT | GAS | COLOR TEMPERATURE (K) | SEGMENTS ENTIRE EMITTING LENGTH (%) | WARM-UP TIME (Sec) | CONTINUOUS TURN-ON LIFE (HOURS) | HEAT CYCLE DURABILITY (TIMES; ON FOR 0.5 Sec & OFF FOR 10 Sec) |
|---|---|---|---|---|---|---|
| 1 | Ar | 2400 | 45 | 11.0 | NO BREAKAGE IN 3,000 HOURS | NO BREAKAGE IN 100,000 TIMES |
| 2 | 〃 | 2500 | 45 | 10.3 | 2300 | 40000 |
| 3 | 〃 | 2600 | 45 | 10.2 | 1200 | 20000 |
| 4 | Kr | 2400 | 45 | 9.9 | NO BREAKAGE IN 3,000 HOURS | NO BREAKAGE IN 100,000 TIMES |
| 5 | 〃 | 2500 | 45 | 9.5 | NO BREAKAGE IN 3,000 HOURS | 50000 |
| 6 | 〃 | 2600 | 45 | 9.4 | NO BREAKAGE IN 3,000 HOURS | 30000 |
| 7 | Xe | 2400 | 45 | 9.8 | NO BREAKAGE IN 3,000 HOURS | NO BREAKAGE IN 100,000 TIMES |
| 8 | 〃 | 2500 | 45 | 9.3 | NO BREAKAGE IN 3,000 HOURS | 50000 |
| 9 | 〃 | 2600 | 45 | 9.0 | NO BREAKAGE IN 3,000 HOURS | 30000 |

Fig. 27

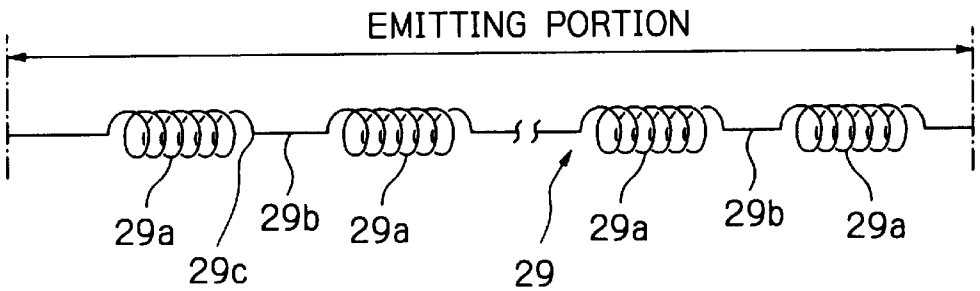

Fig. 28

| EXPERI-MENT | GAS | COLOR TEMPERATURE (K) | SEGMENTS ENTIRE EMITTING LENGTH (%) | WARM-UP TIME (Sec) | CONTINUOUS TURN-ON LIFE (HOURS) | HEAT CYCLE DURABILITY (TIMES; ON FOR 0.5 Sec & OFF FOR 10 Sec) |
|---|---|---|---|---|---|---|
| 10 | Kr | 2500 | 50 | 9.5 | NO BREAKAGE IN 3,000 HOURS | NO BREAKAGE IN 100,000 TIMES |
| 11 | 〃 | 2500 | 55 | 9.6 | NO BREAKAGE IN 3,000 HOURS | NO BREAKAGE IN 100,000 TIMES |
| 12 | 〃 | 2500 | 60 | 9.7 | NO BREAKAGE IN 3,000 HOURS | NO BREAKAGE IN 100,000 TIMES |
| 13 | Xe | 2500 | 50 | 9.3 | NO BREAKAGE IN 3,000 HOURS | NO BREAKAGE IN 100,000 TIMES |
| 14 | 〃 | 2500 | 55 | 9.3 | NO BREAKAGE IN 3,000 HOURS | NO BREAKAGE IN 100,000 TIMES |
| 15 | 〃 | 2500 | 60 | 9.4 | NO BREAKAGE IN 3,000 HOURS | NO BREAKAGE IN 100,000 TIMES |

| EXPERI-MENT | GAS | COLOR TEMPERATURE (K) | SEGMENT ENTIRE EMITTING LENGTH (%) | WARM-UP TIME (Sec) | CONTINUOUS TURN-ON LIFE (HOURS) | HEAT CYCLE DURABILITY (TIMES; ON FOR 0.5 Sec & OFF FOR 10 Sec) |
|---|---|---|---|---|---|---|
| 16 | Kr | 2500 | 45 | 9.4 | NO BREAKAGE IN 3,000 HOURS | NO BREAKAGE IN 100,000 TIME |
| 17 | Xe | 2500 | 45 | 9.2 | NO BREAKAGE IN 3,000 HOURS | NO BREAKAGE IN 100,000 TIME |

IMAGE FORMING APPARATUS AND FIXING DEVICE THEREFOR

BACKGROUND OF THE INVENTION

The present invention relates to a copier, printer, facsimile apparatus or similar image forming apparatus and more particularly to a fixing device included in an image forming apparatus for fixing a toner image on a recording medium by using a halogen heater as a heat source.

A copier, for example, electrostatically forms a latent image representative of a document image on a photoconductive element or image carrier, develops the latent image with developing means to thereby produce a corresponding toner image, and transfers the toner image to a paper sheet or similar recording medium The copier then fixes the toner image on the paper sheet with a fixing device including a heat roller. The fixing device generally uses a halogen heater or similar radiation heater or radiation heat source. The radiation heater includes a glass tube accommodating a tungsten filament and filled with inactive gas, which is generally nitrogen, argon or krypton. This kind of fixing device is low cost, safe and long life and extensively used in various image forming apparatuses including a copier.

The above-described type of fixing device includes a heat roller and a press roller pressed against the heat roller. While a paper sheet is passed through a nip between the heat roller and the press roller, a toner image carried on the paper sheet is fixed by heat and pressure. The halogen heater is accommodated in the heat roller in order to heat the heat roller by radiating heat. This kind of heating system is generally referred to as an indirect heating system In a direct heating system the heat roller is provided with a heat generating layer on its inner or outer periphery, so that the surface of the roller generates heat. The indirect heating system needs a longer period of time for the heat roller to be warmed up to a preselected fixing temperature than the direct heating system There has recently been developed an energy saving type of fixing device including a heat roller implemented by a tubular base that is formed of aluminum or iron and has a wall thickness as small as about 0.5 nm This type of fixing device reduces the warm-up time of the heat roller to the fixing temperature even to about 10 seconds. Such a short warm-up time makes it needless to feed preheating current to the developing device even in a stand-by state. This, coupled with the fact that the fixing device can be turned off when not used, successfully saves energy. However, the warm-up time of the heat roller is longer than the warm-up time available with the direct heating system.

Japanese Patent Laid-Open Publication No. 11-174899 discloses a fixing device including a constant voltage circuit for reducing voltage variation. This fixing device uses heating means having a color temperature of 2,400 K or above.

More specifically, the halogen heater is filled with the previously mentioned inactive gas and a trace of halogen substance, e.g., iodine, bromine or chlorine. Usually, tungsten starts vaporizing at a temperature below its melting point and decreases in diameter little by little until it snaps. In the case of the halogen heater, tungsten vaporized from the filament repeatedly reacts with halogen gas confined in the glass tube and decomposes. Such a halogen cycle provides the halogen heater with necessary durability.

Today, a halogen heater not filled with a halogen substance or accommodating a carbon filament, which performs far infrared radiation, is under development from the environment standpoint.

The glass tube of the halogen heater is formed of quartz glass in order to withstand high temperature, which is necessary to maintain the halogen cycle. Quartz is either transparent quartz made from crystal or semitransparent quartz made from silica. A tube formed of semitransparent quartz is low in transparency, but low cost and equivalent with transparent quarts as to other physical properties. A semitransparent quartz tube is therefore usually applied to the halogen heater that does not need a precise optical characteristic. The semitransparent quartz tube has a transmission of about 80% with respect to light having a wavelength of 300 nm to 3,000 mm. Generally, a conventional semitransparent quartz tube has an outside diameter of 6 mm to 10 mm and a wall thickness of 1.0 mm to 1.2 mm.

A relation between the heat radiation from the halogen heater having the above-described specification and losses has generally been grasped as experimental values in the steady state, i.e, at the fixing temperature. Specifically, it is generally understood that infrared radiation to the inner surface of the heat roller is about 86%, visible radiation is about 7%, a terminal loss is about 2%, and a loss ascribable to the glass tube is about 5%.

The problem with the indirect heating type of fixing device is that the warm-up of the heat roller to the fixing temperature is slow, as stated earlier. If the warm-up of the heat roller can be accelerated, it is possible to enhance the manipulability of the fixing device or an image forming apparatus using it and to promote energy saving while preserving the various advantages of the indirect heating system.

Generally, the warm-up time of the fixing device using a heat roller is dependent mainly on the thermal capacity of the heat roller, which is a member to be heated. To reduce the warm-up time, it has been customary to reduce the diameter or the wall thickness of the heat roller. However, this kind of scheme reduces the rigidity of the heat roller and makes it impossible to reduce the thermal capacity beyond a certain limit while maintaining the minimum mechanical strength.

As a result of analysis on why the warm-up of the fixing device using a halogen heater is slow, there were found the following causes (1) and (2).

(1) A substantial period of time is necessary for the halogen heater itself to reach a filament temperature of 2,500 K at which radiation is becomes stable. The warm-up time of a 100 V, 1,200 W halogen heater is as long as 1 second or more. The temperature elevation of the heat roller is delayed by such a period of time. The warm-up time of the filament itself increase in proportion to the thermal capacity thereof. More specifically, as the diameter and length of the filament increase the thermal capacity of the filament increases, extending the warm-up time of the filament.

(2) In principle, no losses occur if the entire energy input to the halogen heater is radiated from the filament and then radiated from the inner surface of the heat roller to become heat. In practice, however, the gas around the filament absorbs the heat of the filament due to convection thereof. Further, when light issuing from the filament is transmitted through the glass tube, the glass tube absorbs part of the light. Experiments showed that at the time of warm-up the glass tube end gas confined therein absorbed about one-fourth of the radiation from the filament, allowing only three-fourths of the radiation to be radiated to the inner surface of the heat roller.

The influence of the glass tube and gas confined therein is particularly noticeable in a fixing device of the type causing substantially no radiation to occur from the glass tube to the heat roller and having a short warm-up time, as will be described specifically later. The loss ascribable to the glass tube of the halogen heater is generally considered to be about 5% of the entire radiation and technically unavoidable because of such glow ratio. This ratio, however, holds only in the steady state in which the temperature of the halogen heater is stable. In an energy saving type of fixing device that warms up the heat roller rapidly, the ratio of the logs ascribable to the glass tube during warm-up is as great as about 25%, as determined by experiments. This suggests that there is sufficient room for technical improvement as to the warm-up time of the fixing device using a halogen heater.

The warm-up time to the fixing temperature is generally several 10 seconds. In this sense, a period of time of 1.7 seconds necessary for the radiation heater itself to be warmed up just after the turn-on of a power source may not be long. However, in the energy saving type of fixing device whose warm-up time to the fixing temperature is as short as about 10 seconds, the warm-up time of the radiation heater itself just after the turn-on of the power source is not negligible.

Another problem with the conventional halogen heater is that its response at the time of turn-on and turn-off is slow and brings about the temperature ripple of the heat roller when a paper sheet arrives at the fixing device. Rush current that flows when the power source is turned on is still another problem particular to the halogen heater.

Technologies relating to the present invention are also disclosed in. e.g., Japanese Patent Laid-Open Publication Nos. 7-121041, 7-254393, 9-265246 and 11-174899.

SUMMARY OF THE INVENTION

It is another object of the present invention to provide a fixing device using a halogen heater achieving a short warm-up time and saving energy, and an image forming apparatus including the same.

In accordance with the present invention, a fixing device includes a heat roller accommodating a halogen heater that has a glass tube filled with inactive gas and a halogen substance, and a press roller pressed against the heat roller. The glass tube has a mean transmission of 94% with respect to light having a wavelength of 300 nm to 3,000 nm.

Also, in accordance with the present invention, an image forming apparatus includes a fixing device including a heat roller accommodating a halogen heater that has a glass tube filled with inactive gas and a halogen substance, and a press roller pressed against the heat roller. The glass tube has a mean transmission of 94% with respect to light having a wavelength of 300 nm to 3,000 nm.

BRIEF DESCRIPTION OF THE DRAWINGS

The above and other objects, features and advantages of the present invention will become more apparent from the following detailed description taken with the accompanying drawings in which:

FIG. 13 is a table listing the results of experiments conducted with the combinations shown in FIG. 12;

FIG. 20 is a table listing the results of experiments conducted with various gases and various filament color temperatures;

FIG. 21 is a table listing the results of experiments conducted to determine temperature elevation times in relation to FIG. 20;

FIG. 25 is a table listing the results of experiments conducted with various gases and various filament color temperatures;

FIG. 27 is a view showing a specific configuration of the filament;

FIG. 28 is a table listing the results of experiments conducted with various ratios of segment portions to the entire filament;

DESCRIPTION OF THE PREFERRED EMBODIMENTS

Figure 1:
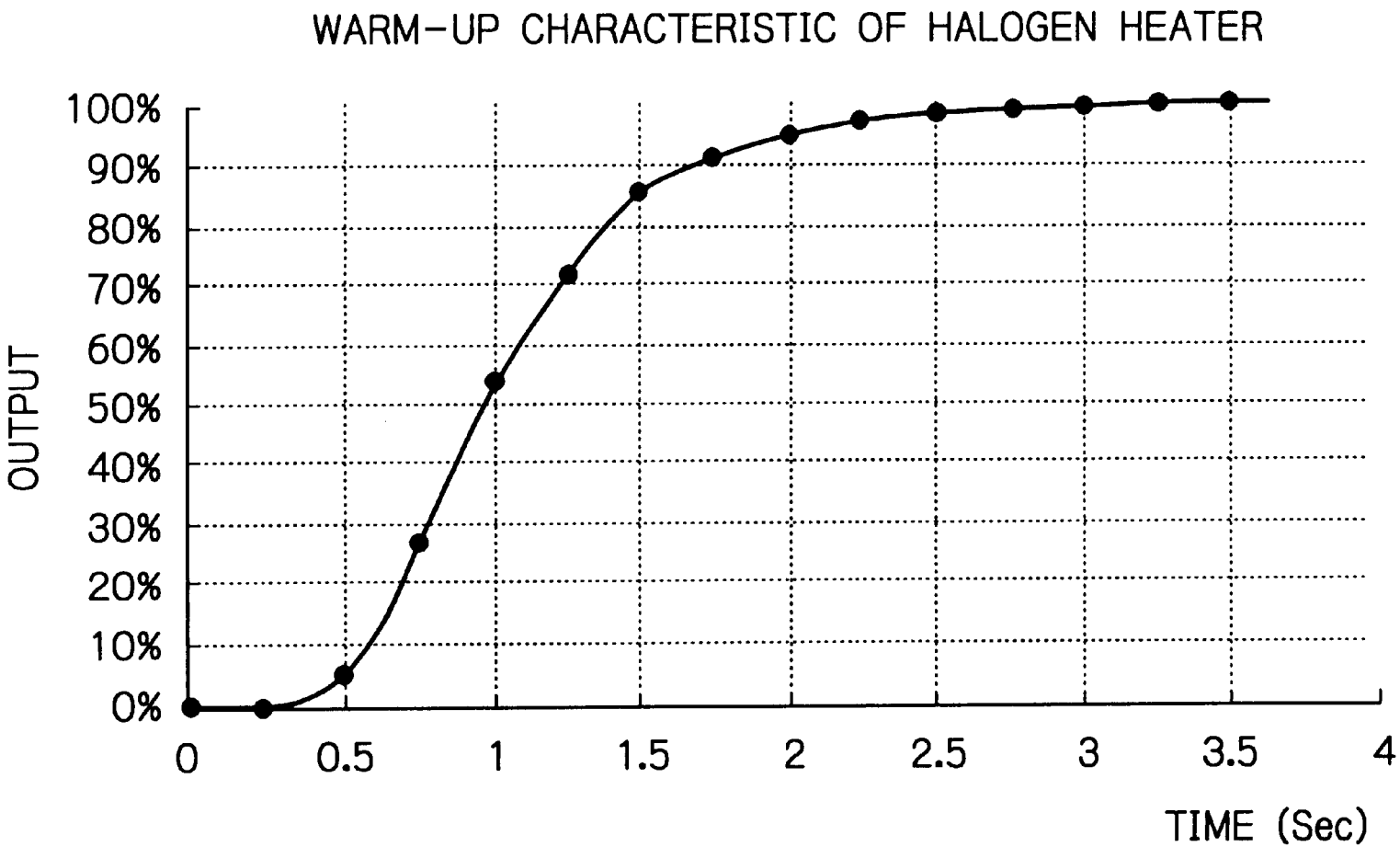
FIG. 1 is a graph showing the warm-up characteristic of a halogen heater.
Figure 2:
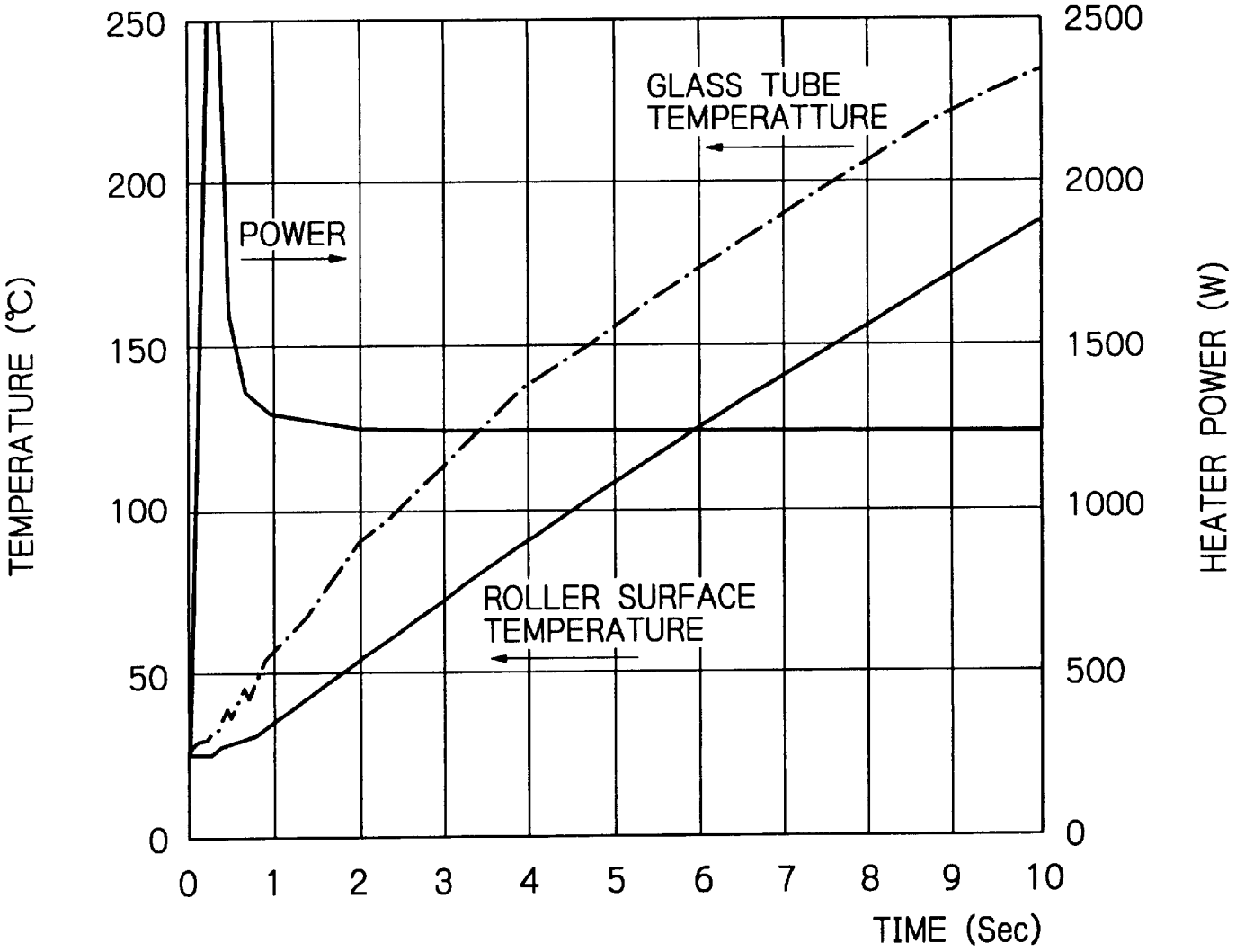
FIG. 2 is a graph showing a relation between the temperature elevation of a conventional heat roller included in an energy saving type of fixing device and having a thin wall, the temperature elevation of a glass tube included in a halogen heater, and power input to the halogen heater.

To better understand the present invention, why a fixing device using a halogen heater needs a long warirup time will be described with reference to FIGS. 1 through 3. FIG. 1 shows the warm-up characteristic of a halogen heater. As shown, it takes almost 2 seconds (about 1.7 seconds) for the output of a halogen heater to reach a 90% output since the turn-on of a power source. This period of time is necessary for a filament itself to be stabilized at a color temperature. Such a warm-up time is dependent on the thermal capacity, i.e., volume of the filament and decreases with a decrease in the diameter and length of the filament.

A warm-up time to a fixing temperature has been as long as about several ten seconds until the development of an energy saving type of fixing device achieving a warm-up time of about 10 seconds. In this sense, the warm-up time of about 1.7 seconds necessary for the heater itself to reach the fixing temperature may be short. However, the ratio of the period of time of about 1.7 seconds to the about 10 seconds of warm-up time of the energy saving type of fixing device is great. In this respect, there is room for improvement in further reducing the warm-up time to less than 10 seconds.

Assume an energy saving type of fixing device using a heat roller having a small wall thickness. FIG. 2 shows a relation between the temperature elevation of a core included in the heat roller, the temperature elevation of a glass tube included in a halogen heater, and power input to the halogen heater. As shown, the temperature elevation is slow for about 1 second since the turn-on of a power source. This period of time is necessary for tungsten forming a filament to be heated to about 2,500 K. During this period of time, power rises because the resistance of tungsten depends on temperature (PTC characteristic). The filament color temperature in the subsequent range where power is stabilized is set as a rated color temperature.

On the elapse of about 10 seconds in which the core of the heat roller reaches a fixing temperature of 180° C. the wall of the glass tube included in the halogen heater reaches about 230° C. The amount of energy absorbed in the glass tube is estimated to be about 270 W on the basis of such a temperature elevation rate and the thermal capacity of glass:

$$\text{thermal capacity (J/K)} \times \text{temperature elevation rate (K/sec)} = \text{amount of heat generated (W)}$$

Because the power is 1,200 W, about one-fourth of the energy radiated from tungsten is lost by being absorbed by the glass tube.

Figure 3:
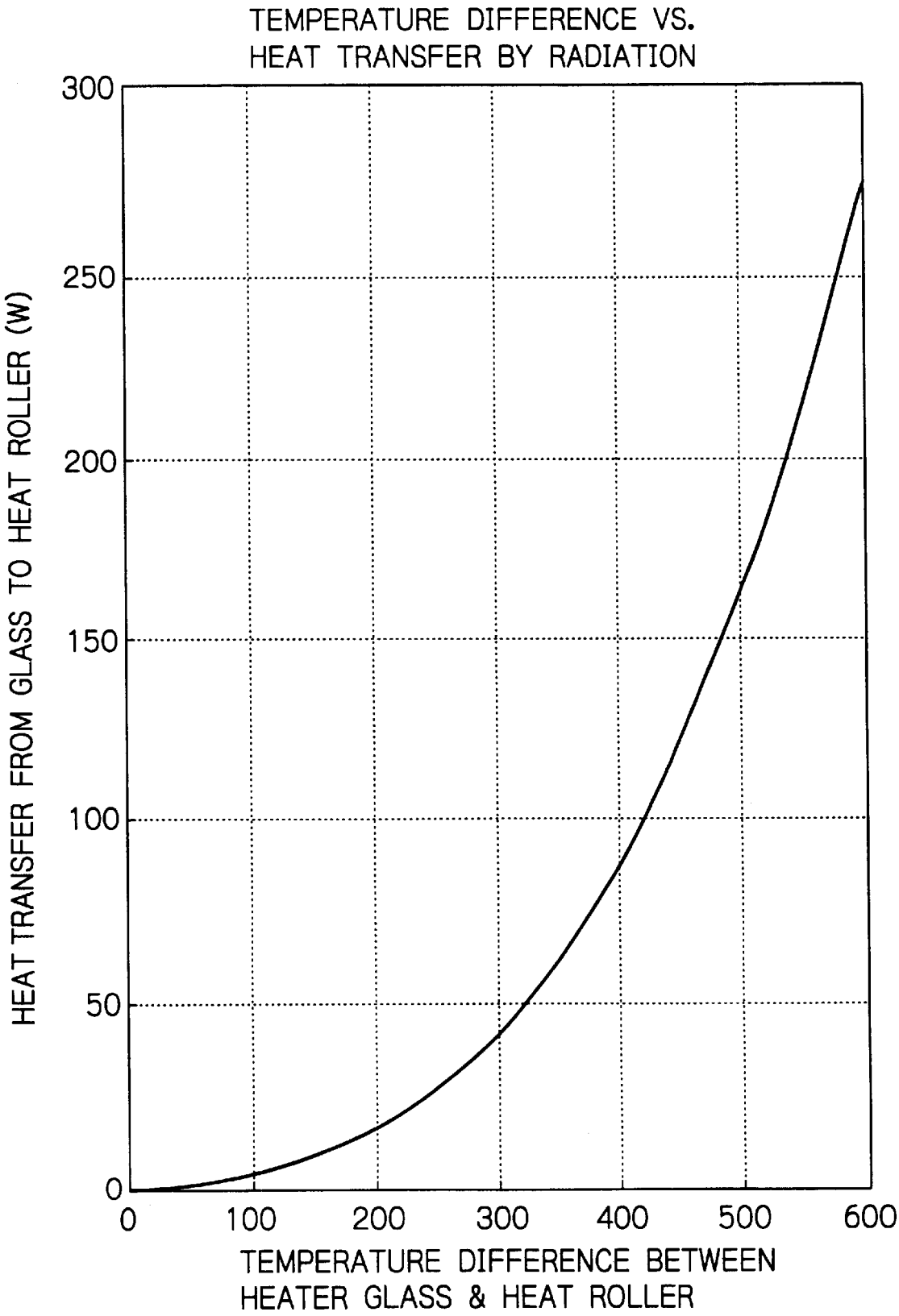
FIG. 3 is a graph showing a relation between a difference in temperature between the glass tube and the heat roller and the amount of heat transferred by radiation.

FIG. 3 shows a relation between a difference in temperature between the glass tube and the heat roller and heat transfer based on radiation. As shown, the amount of heat transfer sharply increases when the temperature difference exceeds about 200° C. Because heat transfer based on radiation is proportional to a difference of the fourth power of temperature, the influence of radiation increases with an increase in temperature. However, before the difference in temperature between the glass tube and the heat roller becomes noticeable, heat transfer from in the glass tube to the heat roller due to radiation may be neglected. In this sense, heating the glass tube itself is not significant.

Figure 4:
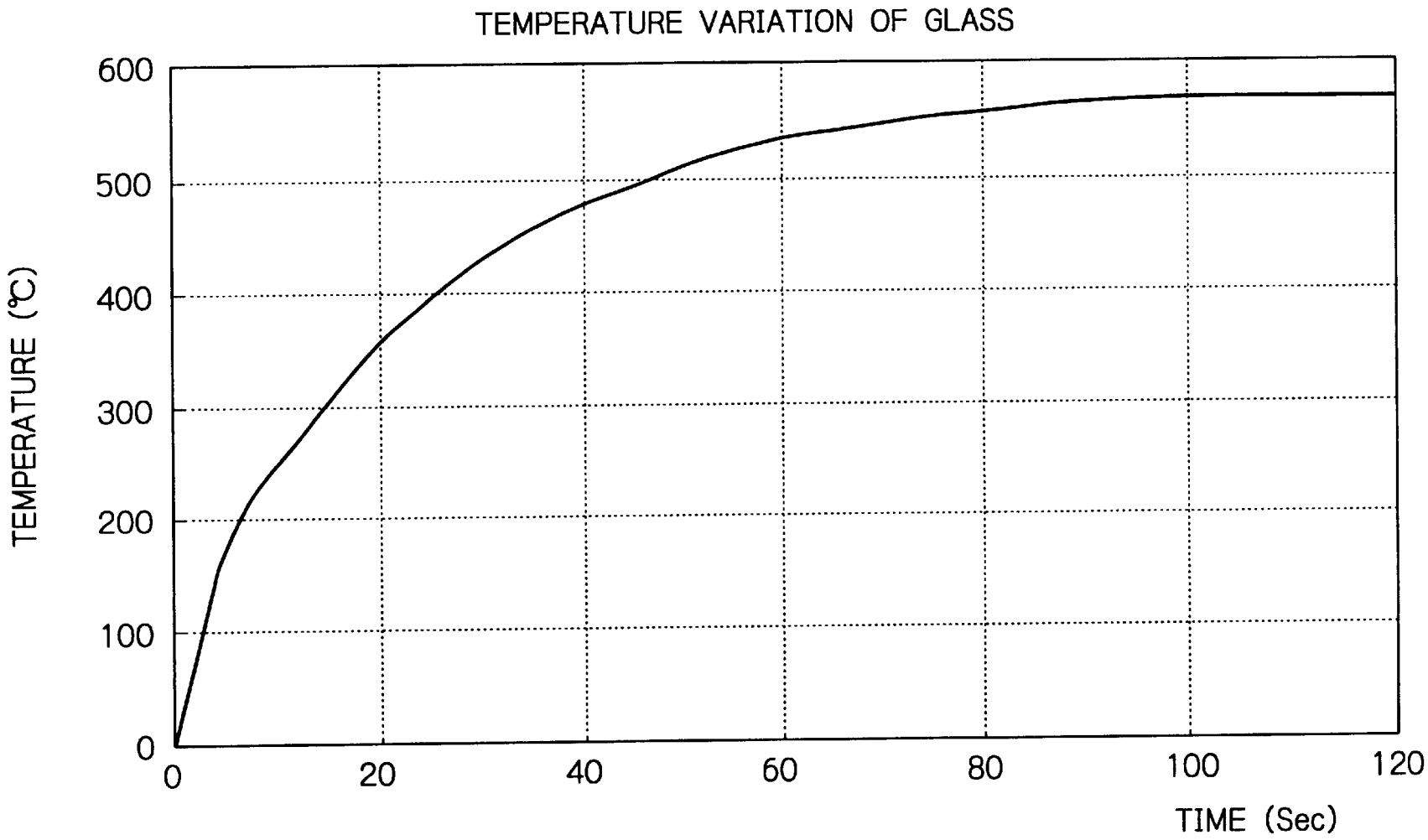
FIG. 4 is a graph showing the temperature elevation of the glass tube.

On the other hand, as shown in FIG. 4, the glass tube is heated up to about 500° C. in 2 seconds if no control is executed. At such a glass tube temperature, radiation from the glass tube to the heat roller is presumably sufficiently great.

Figure 5:
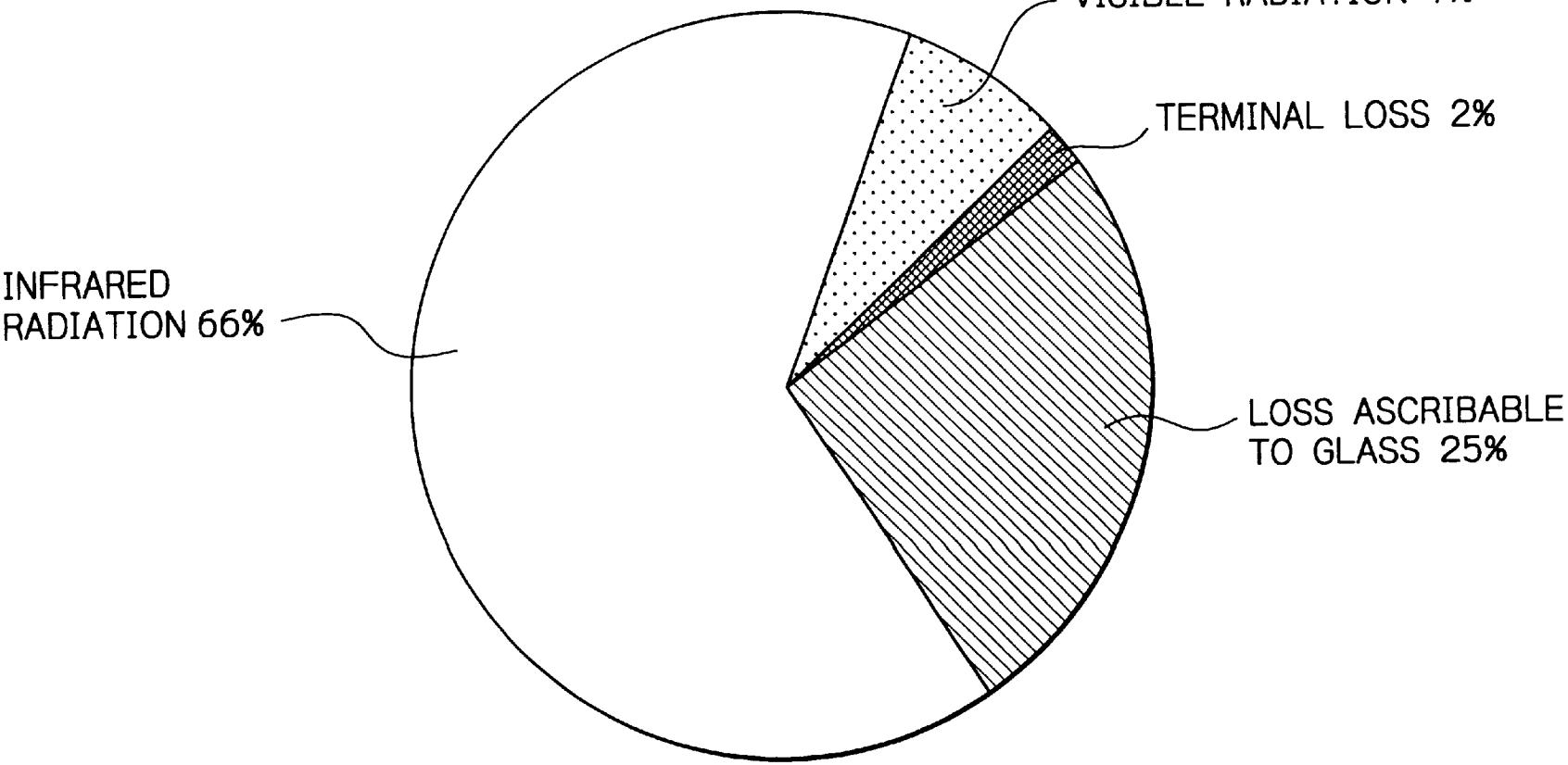
FIG. 5 is a graph showing the heat radiation from the halogen heater and losses occurring during warm-up.

The various data described above suggest that the glass tube and gas confined therein have particularly great influence in a short warm-up type of fixing device in which radiation from the glass tube to the heat roller occurs little. It has customarily been considered that a loss in the glass tube of a halogen heater is as small as about 5% of the entire radiation and not avoidable in the technical aspect. Such a loss, however, occurs only in a steady condition wherein the temperature of the halogen heater is stable, as stated earlier. As shown in FIG. 5, in the energy saving type of fixing device that heats the fixing roller in a short period of time, the loss in the glass tube is as great as about 25%, which is about five times as great as the loss in the steady condition. This was proved by a series of experiments.

Figure 6:
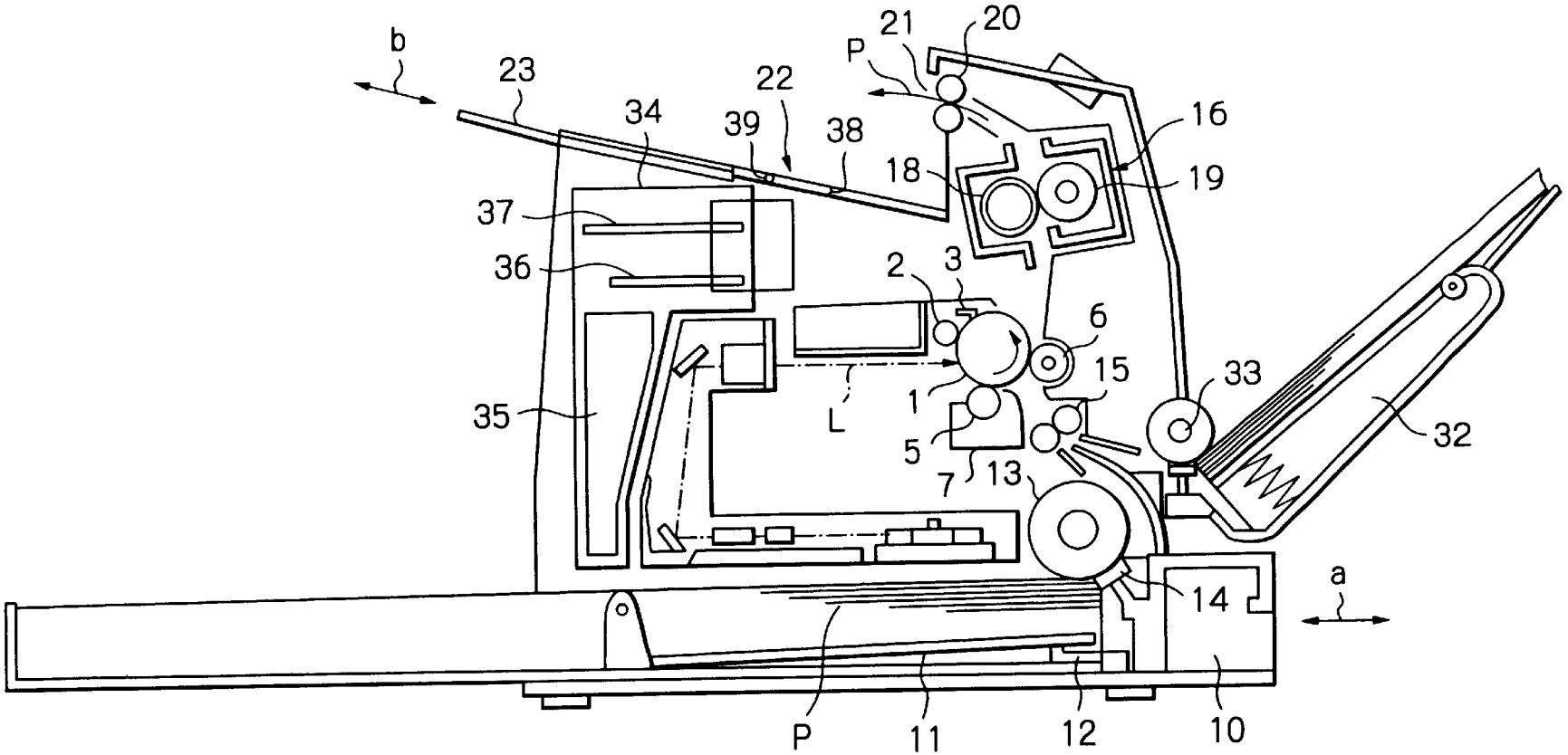
FIG. 6 is a side elevation showing an image forming apparatus embodying the present invention.

Preferred embodiments of the present invention will be described hereinafter. First, reference will be made to FIG. 6 for describing an image forming apparatus in accordance with the present invention and implemented as a copier by way of example. As shown, the image forming apparatus includes a photoconductive element implemented as a drum 1, which is rotatable in a direction indicated by an arrow. Arranged around the drum 1 are a charger 2, a cleaner 3, laser optics represented by a laser beam L, a developing unit 7 including a developing sleave 5 for developing a latent image formed on the drum 1, and an image transfer unit 6.

A paper cassette 10 is positioned in the bottom portion of the copier and mounted to or dismounted from the copier in a direction indicated by an arrow a, as desired. The paper cassette 10 includes a base plate 11 supporting a stack of paper sheets P. A spring, not shown, constantly biases the bass plate 11 upward via an arm 12, so that the top paper sheet P is pressed against a pickup roller 13. In response to a command output from a controller, which will be described later, the pickup roller 13 rotates to pay out the top paper sheet P from the paper cassette 10. At this instant, a separator pad 14 prevents the paper sheets P under lying the top paper sheet P from being paid out together. As a result, only the top paper sheet P is conveyed to a registration roller pair 15.

The registration roller pair 15 conveys the paper sheet P toward the image transfer unit 6 such that the leading edge of the paper sheet P meets the leading edge of a toner image formed on the drum 1. After the image transfer unit has transferred the toner image from the drum 1 to the paper sheet P, the paper sheet P is conveyed to a fixing device 16. The fixing device 16 includes a heat roller 18 and a press roller 19 pressed against each other by a spring, not shown to form a nip therebetween. The paper sheet P with the toner image is passed through the above nip and has the toner image fixed by heat and pressure. The paper sheet P coming out of the fixing unit 16 is driven out to a tray 22 via an outlet 21 face down. A stop 22*a* mounted on the tray 22 is slidable in a direction indicated by an arrow b so as to deal with paper sheets of various sizes.

An operating section is arranged in the right portion of the copier and includes an operation panel 30, which protrudes from the top front portion of a casing 31. A paper feed tray 32 is hinged to the casing 31 by a pin 33. A box 34 positioned in the left portion of the copier accommodates a power source unit 35, printed circuit board (engine driver board) 36 and other electric components as well as a control unit (controller board) 37. A cover 38, constituting the tray 22, is openable about a fulcrum 39.

Figure 7:
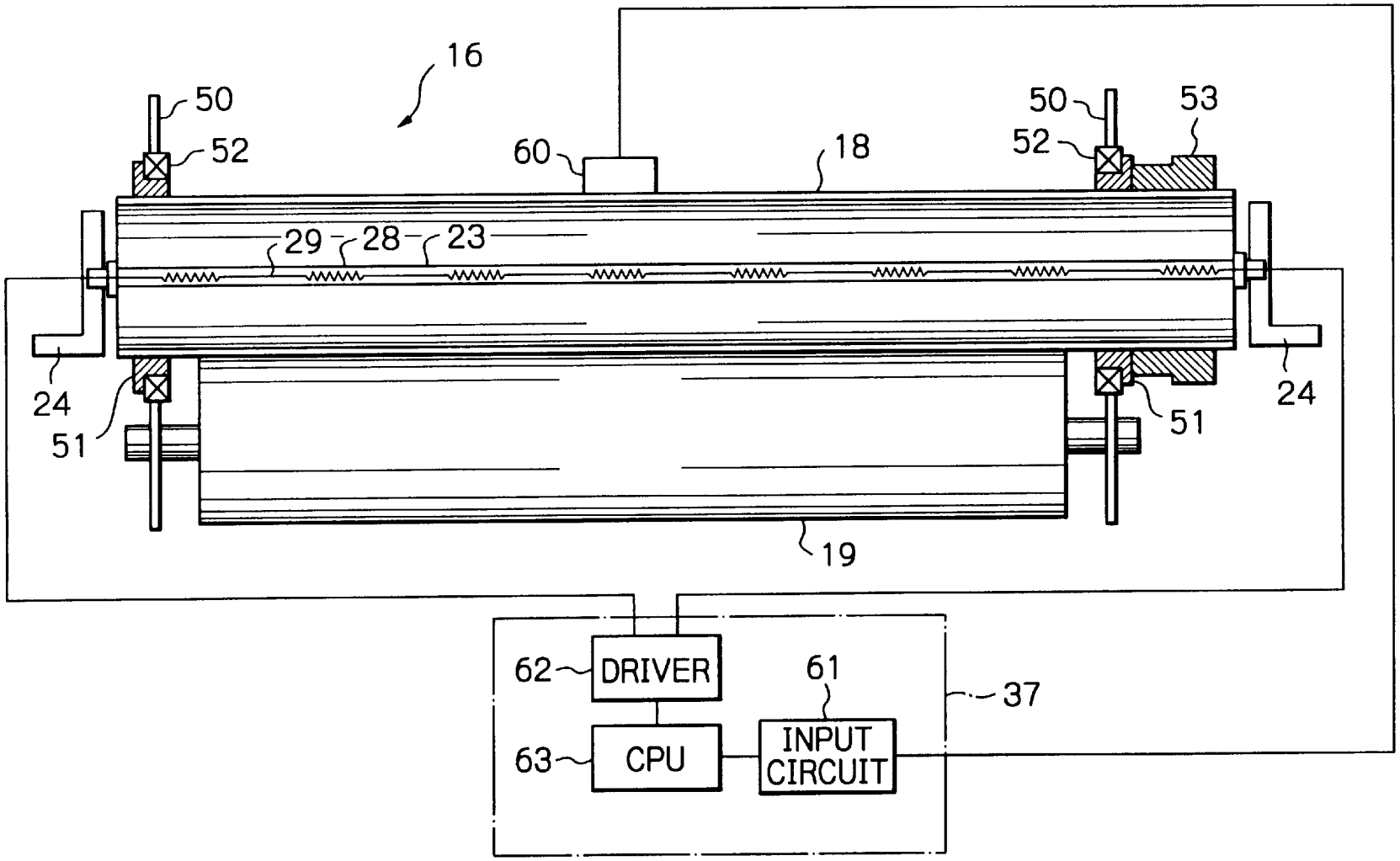
FIG. 7 is a section showing a fixing device included in the apparatus of FIG. 6.

As shown in FIG. 7 in detail, the heat roller 18 is supported by opposite side walls 50 via heat-insulating bushings 51 and bearings 52 A drive source, not shown, causes the heat roller 18 to rotate via a gear 53. A halogen heater 23 is disposed in the heat roller 18 and supported by heater support members 24 at opposite ends thereof. A temperature sensor 60 contacts the surface of the heat roller 18 for sensing the temperature of the heat roller 18. The output of the temperature sensor 60 is input to a CPU (Central Processing unit) 63 included in the control unit 37 via an input circuit 61. The CPU 63 controls current supply to the halogen heater 23 via a driver 62 in accordance with the output of the temperature sensor 60. Usually, when a power switch, not shown, provided on the copier is turned on, a current flows to the halogen heater 23 via the driver 62 and rapidly heats the heat roller 18 to a preselected temperature of about 180° C.

Figure 8:
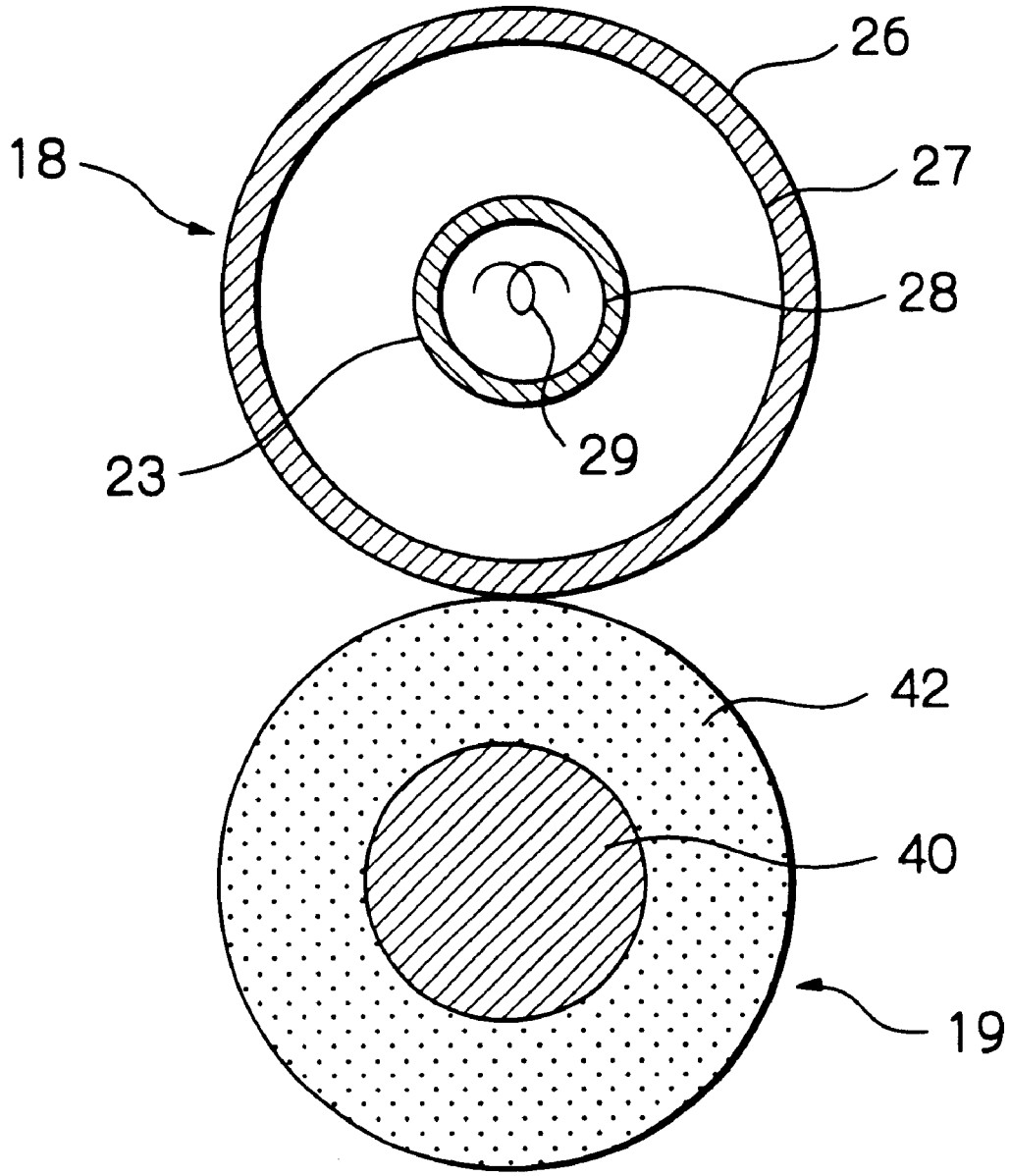
FIG. 8 is a section showing a positional relation between a heat roller and a press roller included in the fixing device of FIG. 7.

As shown in FIG. 8, the heat roller 18 is basically implemented as a metallic pipe 27 formed of aluminum or iron and having a wall thickness as small as 0.8 mm or below (e.g. 0.4 mm). The pipe 27 is covered with a parting layer 26 formed of a fluorine-containing material for enhancing the separation of the paper sheet P after fixation. The halogen heater 23 is made up of a tungsten filament 29 and a glass tube 28 enclosing the filament 29. The glass tube 28 is filled with inactive gas whose major component is krypton or xenon, and a trace of iodine bromine, chlorine or similar halogen substance. The press roller 19 is made up of a metallic core 40 and a foam silicone rubber layer 42, which is a specific foam material.

Figure 9A:
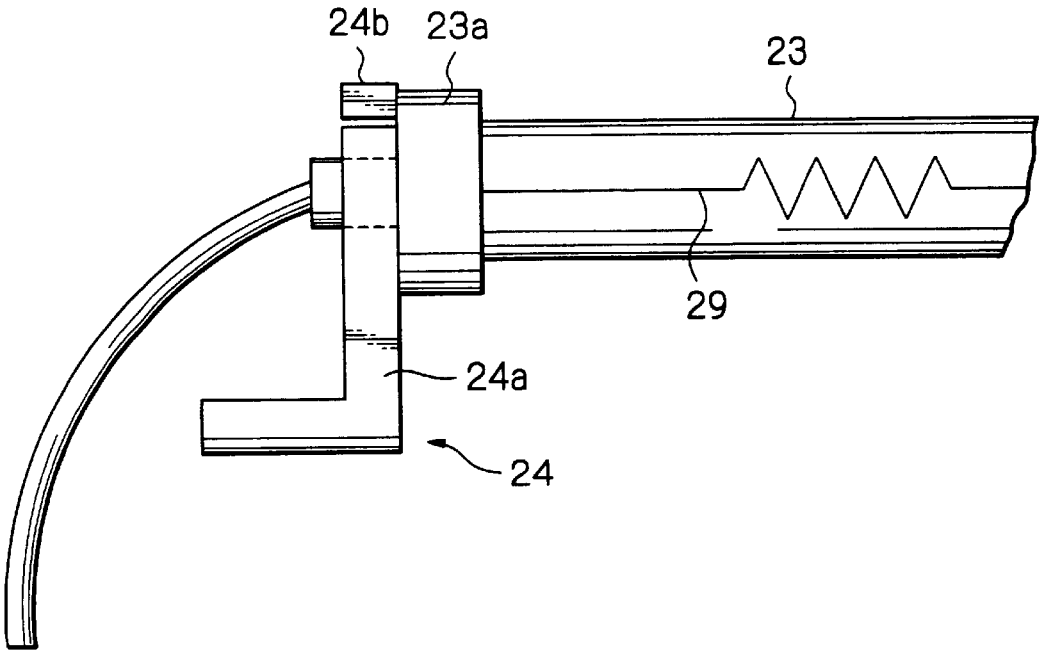
FIGS. 9A and 9B are views showing a structure for supporting the halogen heater included in the fixing device of FIG. 7.
Figure 9B:
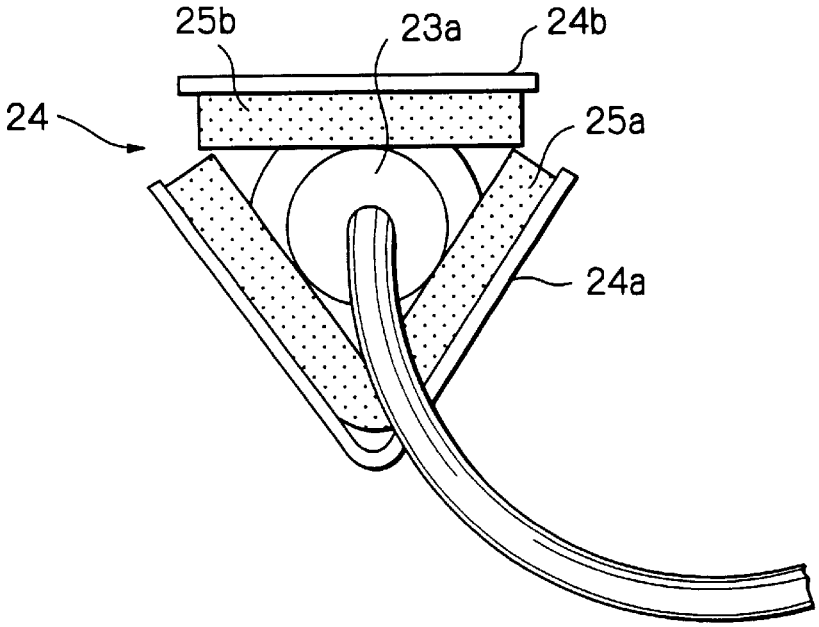

A structure for supporting the and of the halogen heater 23 will be described specifically with reference to FIGS. 9A and 9B. As shown, the heater support member 24 includes a generally V-shaped base 24*a* and a cover 24*b*. Pieces of ceramic felt 25*a* and 25*b* are fixed in place between the base 24*a* and the cover 24*b* and complementary in configuration to the base 24*a* and cover 24*b*, respectively. The pieces 25*a* and 25*b* play the role of heat resistant, shock absorbing numbers capable of absorbing vibrations and shocks. More specifically, the V-shaped piece 25*a* supports a terminal portion 23*a* included in the halogen heater while the piece 25*b* presses the terminal portion 23*a* downward.

The structure described above protects the halogen heater 23 from damage ascribable to shocks and vibrations during production process, which is unique to the present invention and increases transmission by reducing the wall thickness of the glass tube 28, as well as during distribution and operation.

First Embodiment

To reduce a heat loss ascribable to the glass tube 28 and therefore the warm-up time of the fixing unit 16, the transmission of the glass tube 28 may be increased. The transmission of the glass tube 28 can be increased if the wall thickness of the tube 28 is reduced or if the transparency of the same is increased.

In the illustrative embodiment, the glass tube 28 has a mean transmission of 94% or above with respect to light whose wavelength is 300 nm to 3,000 nm. By increasing the conventional transmission of 80% to 94% or above, it is possible to improve the efficiency of the halogen heater 23 at the time of warm-up and therefore to reduce the heat loss ascribable to the glass tube 28, which absorbs radiation from the tungsten filament 29, to 5% or below. More specifically, the transmission of the glass tube 28 can be increased if the wall thickness of the glass tube 28 is reduced, if the transparency of the same is increased, or if such schemes are affected in combination.

Figure 10:
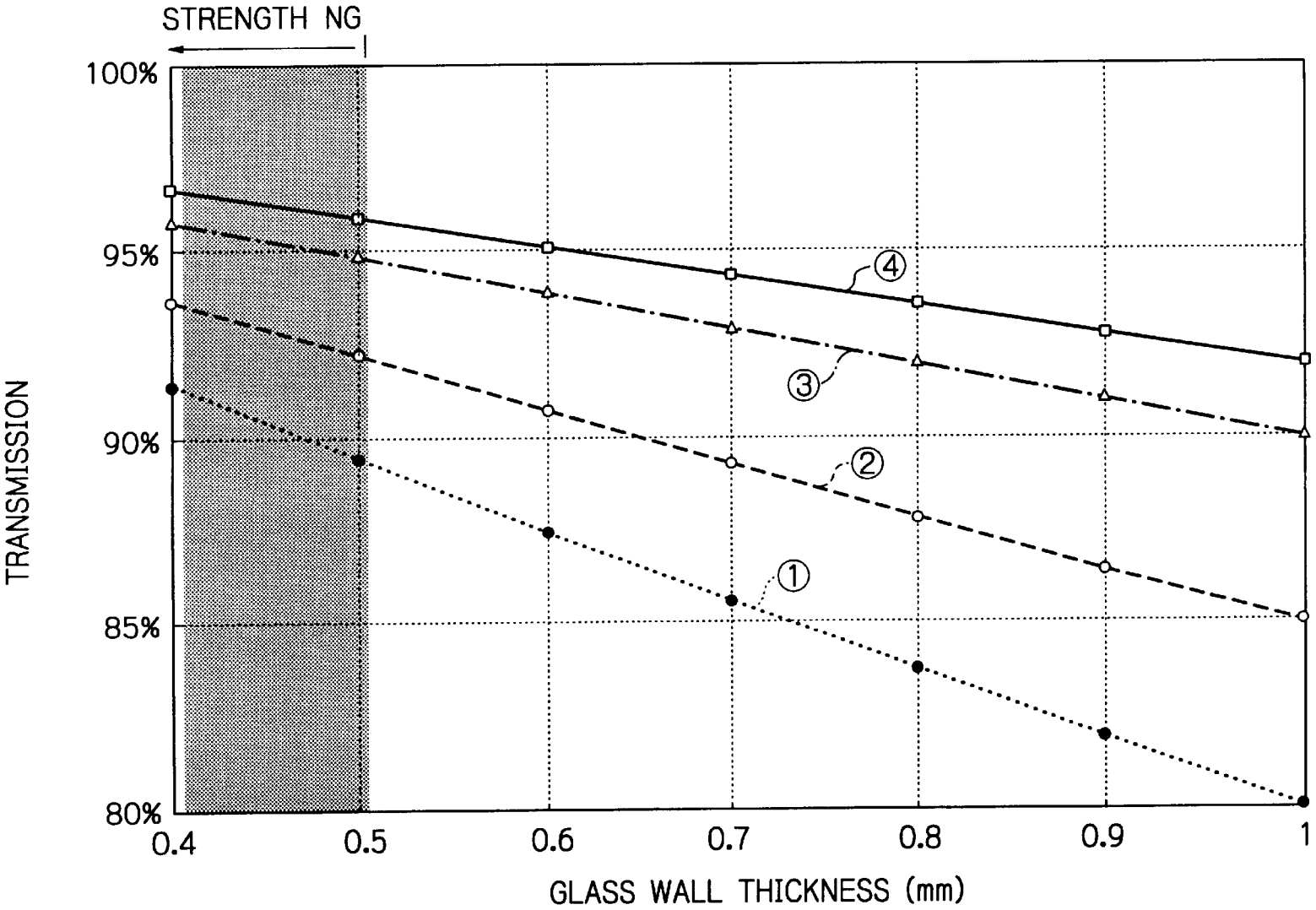
FIG. 10 is a graph showing a relation between the wall thickness of a glass tube and the transmission.

FIG. 10 shows experimental data representative of a relation between the wall thickness of the glass tube 28 and the transmission. In FIG. 10, a curve ① corresponds to a glass tube having a wall thickness of 1 mm and a transmission of 80% (conventional). Curves ② and ③ correspond to a glass tube having a wall thickness of 1 mm and a transmission of 85% and a glass tube having a wall thickness of 1 mm and a transmission of 90%, respectively. Further, a curve ④ corresponds to a glass tube having a wall thickness of 1 mm and a transmission of 92%. The glass tubes represented by the curves ②, ③ and ④ are formed of transparent quartz made from crystal; differences in transmission are derived from differences in content. When use is made of, e.g., the glass tube 28 whose transmission is 92% (curve ④), the transmission is high enough to reduce the heat loss in the glass tube 28 despite the conventional wall thickness (1 mm. In this case, a transmission of 94% or above is achievable if the wall thickness is further reduced to 0.7 mm.

As also shown in FIG. 5, the transmission can be increased even with the conventional material (transmission of 80%) if the wall thickness of the lass tube 28 is reduced to 0.8 mm or below In FIG. 5, in a zone labeled "Strength NG", damage or similar trouble is likely to occur in the support structure described with reference to FIGS. 9A and 9B.

Figure 11:
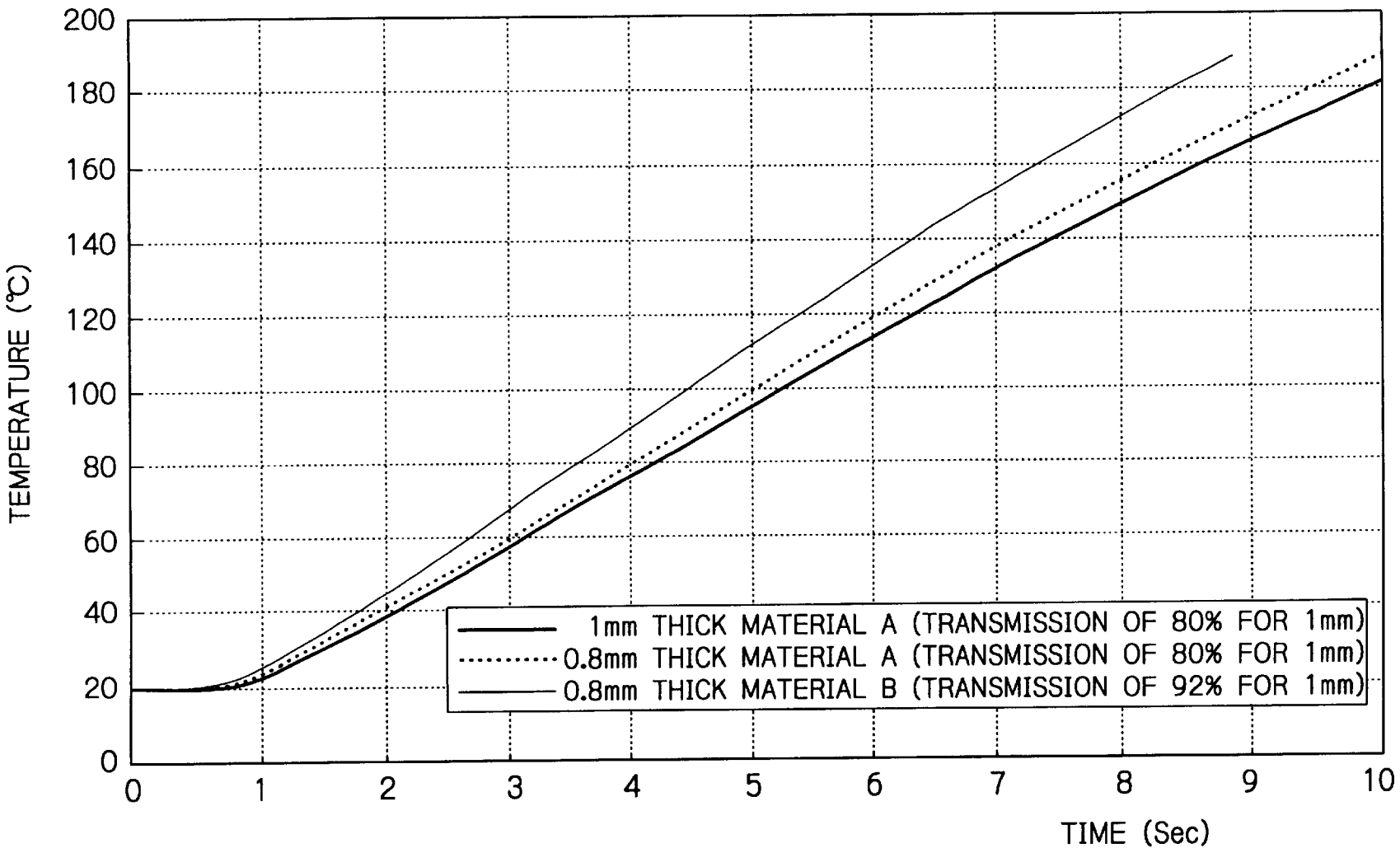
FIG. 11 is a graph showing a relation between the kind of the glass tube of the halogen heater and the temperature elevation of the heat roller.

FIG. 11 shows experimental data representative of a relation between time and the temperature of the heat roller 18 with respect to the kind of the halogen heater 23, i.e., the kind of the glass tube 28. In FIG. 11, a bold solid curve corresponds to a glass tube having a wall thickness of 1 mm and a transmission of 80% for 1 mm (conventional). A dotted curve corresponds to a glass tube having a wall thickness of 0.8 mm and a transmission of 80% for 1 mm. Further, a thin solid curve corresponds to a glass tube having a wall thickness of 0.8 mm and a transmission of 92% for 1 mm. As shown, while the conventional glass tube represented by the bold solid curve needs a warm-up time of more than 10 seconds, the glass tube represented by the thin solid curve needs only a warm-up time of about 8.3 seconds, which is less than 10 seconds. This is successful to reduce t warm-up time after the turn-on of the power switch and therefore user's unpleasant feelings, while enhancing the operability of the fixing unit 16 or an image forming apparatus using it.

In the illustrative embodiment, the base of the heat roller 18 is provided with a wall thickness of 0.8 mm or below (e.g. 0.4 mm).

Figure 12:
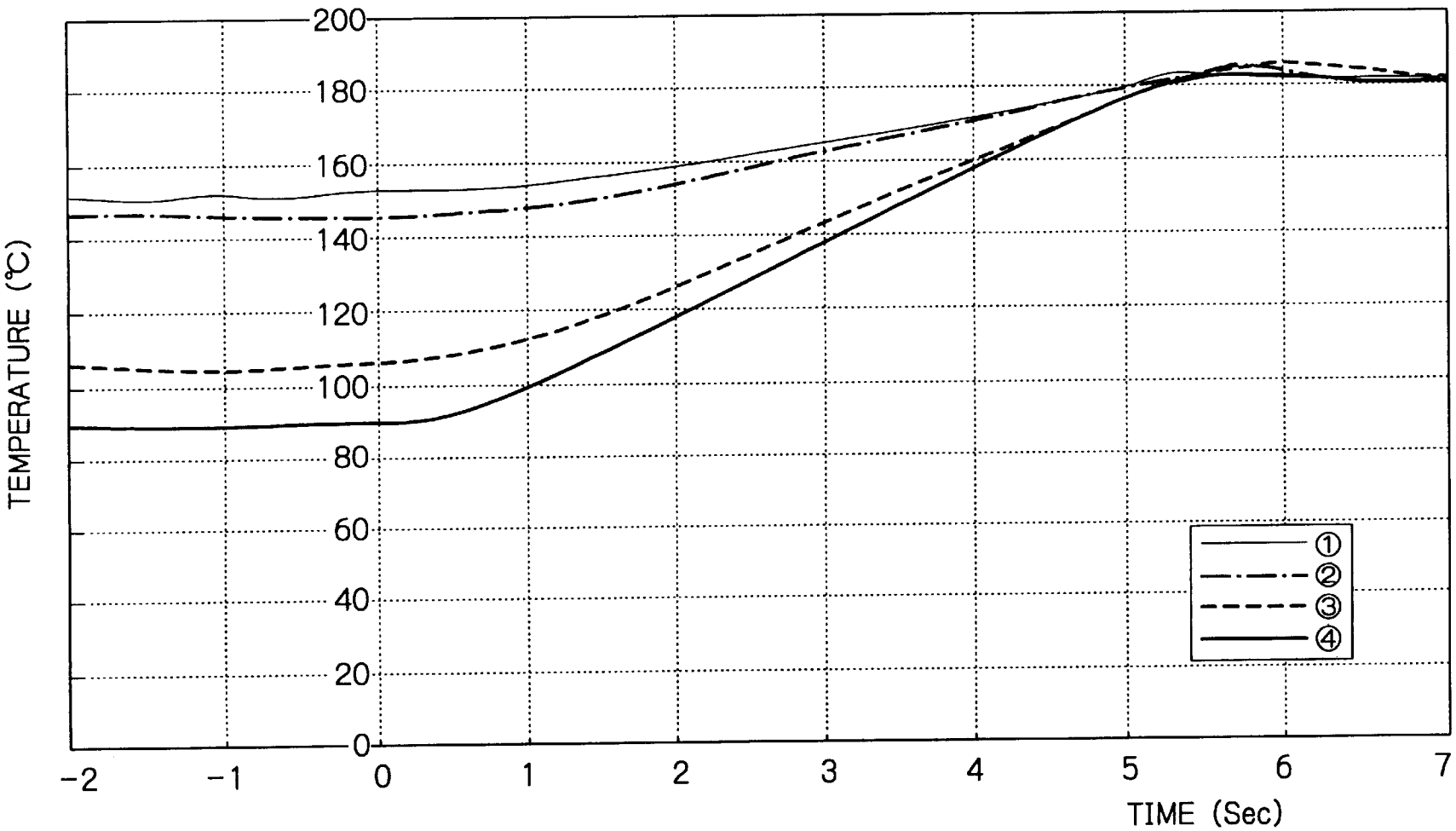
FIG. 12 is a graph showing a relation between the combination of the wall thickness of the heat roller and the transmission of the glass tube and set temperature assigned to a stand-by state.

FIG. 12 shows a relation between temperature and time with respect to a preselected stand-by temperature and the combination of the wall thickness of the base of the heat roller 18 and the transmission of the glass tube 28. All experimental fixing rollers 18 had a pipe with a thin wall and an outside diameter of 30 mm as a core. In FIG. 12, a curve i corresponds to a base having a wall thickness of 0.85 mm and a glass tube 28 having a transmission of 80% (conventional). A curve ② corresponds to a base having a wall thickness of 0.85 mm and a glass tube having a transmission of 94%. A curve ③ corresponds to a base having a wall thickness of 0.4 mm and a glass tube 28 having a transmission of 80%. Further, a curve ④ corresponds to a base having a wall thickness of 0.4 mm and a glass tube having a transmission of 94%. A set temperature for fixation was selected to be 180° C. while a recovery time from a stand-by state to the set temperature for fixation was selected to be 5 seconds. The results of experiments are listed in FIG. 13.

As shown in FIG. 13, as for the curve ①, a set temperature for a stand-by state is 153° C. By contrast, the conditions unique to the Illustrative embodiment (curves ②, ③ and ④) allow the set temperature for a stand-by state to be lowered. Particularly, the combination represented by the curve ④ allows the set temperature to be lowered by more than 60° C.

Figure 14:
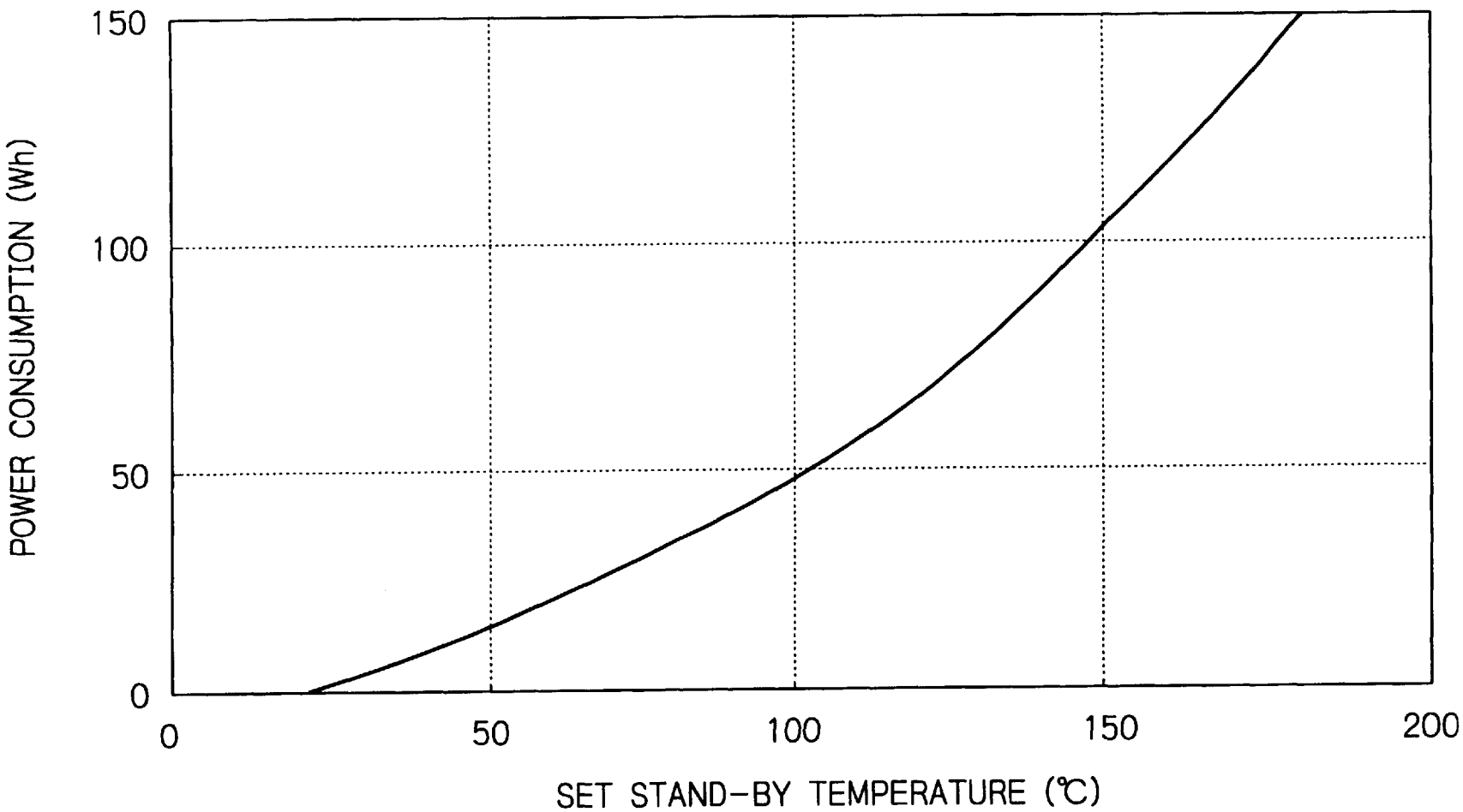
FIG. 14 is a graph showing a relation between the set temperature and power consumption.

More specifically, it has been customary with an image forming apparatus to set a temperature of about 150° C. for a stand-by state in order to implement immediate recovery to the fixing temperature. The illustrative embodiment is capable of implementing the same recovery as the conventional configuration with a lower set temperature for a stand-by state and therefore with a minimum of power. FIG. 14 shows a relation between the set temperature for a stand-by state and power consumption.

By comparing the curves ② and ④, it will be seen that the transmission of the halogen heater 23 has more prominent effect in an energy saving type of image forming apparatus using a wall thickness small enough to accelerate warm-up. That is, the combination of the thin wall of the heat roller 18 and the transmission of the halogen heater 23 is desirable in the warm-up aspect.

Furthermore, as FIG. 13 indicates, the warm-up characteristic can be enhanced only if the wall thickness of the base of the heat roller 16 is reduced, i.e., even if the transmission of the glass tube 28 is not increased.

In the illustrative embodiment the surface layer 42 of the press roller 19 is formed of foam silicone rubber. Foam silicone rubber has hardness low enough to implement a nip width necessary for fixation without exerting a heavy load on the thin heat roller 18. Assume that the press roller 19 has a large diameter. Then, because the heat roller 18 with a thin wall has a small heat capacity, the press roller 19 absorbs the heat of the heat roller 18 when the heat roller 18 is caused to rotate after reaching the preselected temperature. As a result, the surface temperature of the heat roller 18 is again lowered, undesirably extending the warm-up time. Foam silicone rubber has a small thermal capacity and exhibits desirable heat insulation, minimizing the above temperature, drop of the heat roller 18. In this sense, the above configuration of the press roller 19 is essential when it comes to the fixing device 8 featuring a short warm-up time.

The fixing device 16 reduces the warm-up time, as stated above. It follows that the halogen heater 23 can be turned on only when the image forming apparatus is used or turned off in a stand-by state. This kind of control reduces the power consumption of the fixing device 16 to zero in a stand-by state and therefore enhances energy caving to a considerable degree. Of course, although such control realizes faster warm-up from a stand-by state than conventional, warm-up from room temperature is required each time. Therefore, the user should preferably be able to give priority to desired one of low power consumption and manipulability.

Figure 15:
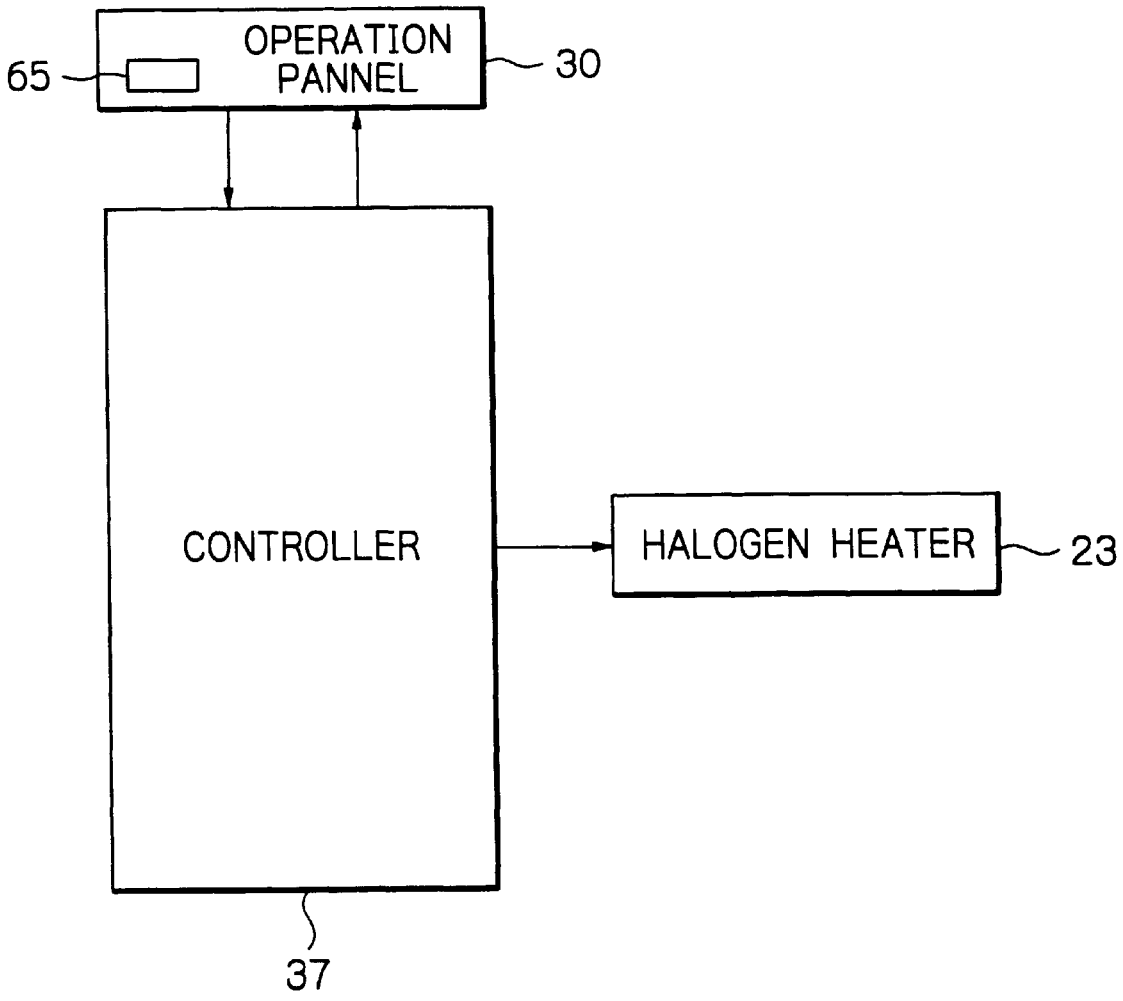
FIG. 15 is a block diagram schematically showing a control system.

FIG. 15 shows a specific control system for implementing the above described control. As shown, the operation panel 30 includes mode setting section 65 that allows the user to select a mode for setting up the preselected stand-by temperature of the fixing unit 16 (a.g. 90° C. of the curve ④ FIG. 13) or a mode for maintaining the halogen heater 23 in an OFF state in accordance with the nature of intended work. When the user selects the latter mode an the mode selecting section 65, the control unit 37 determines that the copier is in a stand-by state on the elapse of a preselected period of time since the end of one job. The control unit 37 then turns off the halogen heater 23. On the other hand, when the user selects the former mode on the mode selecting section 65, the controller 37 makes the above decision and then controls the halogen heater 23 so as to heat the fixing device 16 to, e.g., 90° C.

As stated above, the illustrative embodiment has various unprecedented advantages, as enumerated below.

(1) A glass tube included in a halogen heater can have its transmission increased so as to reduce a heat loss in the tube.

(2) An increase in the transmission of the glass tube is successful to promote rapid warm-up of a fixing device.

(3) The glass tube with a high transmission and a heat roller having a thin wall further promotes rapid warm-up in combination.

(4) The temperature of the heat roller with a thin wall is prevented from being lowered.

(5) The halogen heater is protected from damage during, e.g., transport.

(6) Remarkable energy saving is achieved in a stand-by state.

(7) The user can select a desired mode assigned to a stand-by state in accordance with the nature of intended work.

Second Embodiment

In an alternative embodiment to be described, the color temperature of the tungsten filament 29 during fixation is selected to be 2,500 K or above. A color temperature is determined by the diameter and length of the tungsten filament 29, the kind of gas a confined in the glass tube 28, and input power. A color temperature refers to the temperature of a perfect radiator radiating light of the same color as light radiated from a given radiator. When the rated power and voltage of the halogen heater 23 are determined, resistance is automatically determined, so that the diameter and length of the tungsten filament 29 are adjusted. Resistance is proportional to the length of the tungsten filament 29, but inversely proportional to the cross-section of the same. Therefore, If the tungsten filament 29 has a diameter of 80%, a heater having the saw resistance can be produced with the length of 64% (=0.8^2) and the thermal capacity (=volume) of 51.2% (=0.8^3). It follows that the diameter of 80% reduces the period of time necessary for the filament to reach the same temperature with the same amount of heat to about one-half.

A color temperature is dependent on a heat generating length, the amount of heat generation and the amount of cooling and is determined by the diameter and length of a filament and the kind of gas confined. For a given heater, when voltage is raised, the amount of heat generated and therefore the color temperature rises. Also, for a given filament, the color temperature depends on the density of turns. However, as far as a halogen heater, which is a specific radiation source, used in the illustrative embodiment is concerned, rated voltage, rated power and overall length are determined beforehand while a density of turns is confined in a certain range. In this sense, the color temperature is determined by the diameter of a filament used. That is, reducing the diameter of a filament is equivalent to raising the color temperature of a halogen heater.

In the illustrative embodiment, the diameter of a conventional filament for a 2,400 K application is reduced by about 15% to thereby implement a color temperature of 2,550 K A filament with a diameter of 85% has a thermal capacity lowered to about 60%. Although the color temperature is changed only by several percent, both the thermal capacity and warm-up time of a filament are reduced by about 40%.

It has been customary with a fixing device to use a halogen heater whose center value is 2,400 K This is because a conventional heat roller has a large thermal capacity and needs several ten seconds to be warmed up, so that the warm-up time of a filament included in the heater, which is as long as about 2 seconds, is neglected. For a given rate, the service life increases with a decrease in color temperature. This is why the color temperature of a halogen heater has heretofore been limited to about 2,400 K.

A conventional copier using the above described heating device needs a long warm-up time. It is therefore necessary to constantly turn on the halogen heater in order to maintain the heat roller at a temperature above a preselected temperature even when the copier is not used, thereby obviating a waiting time in the event of copying. Further, the filament remains at a certain high temperature due to the heat roller maintained at the above high temperature, so that consideration is not given to the warm-up of the filament.

In the energy saving type of fixing device whose warm-up time is as short as about 10 seconds, the halogen heater is turned on in the stand-by state in order to save energy, as stated earlier. Such a short warm-up time makes it needless to heat the heat roller in the stand-by state and allows the halogen heater to be turned off when the copier is not used. Consequently, the total turning time of the halogen heater up to the end of the life of fixing device is noticeably reduced. It follows that the halogen heater achieves a life comparable with or even longer than conventional one despite the rise of the color temperature.

Figure 16:
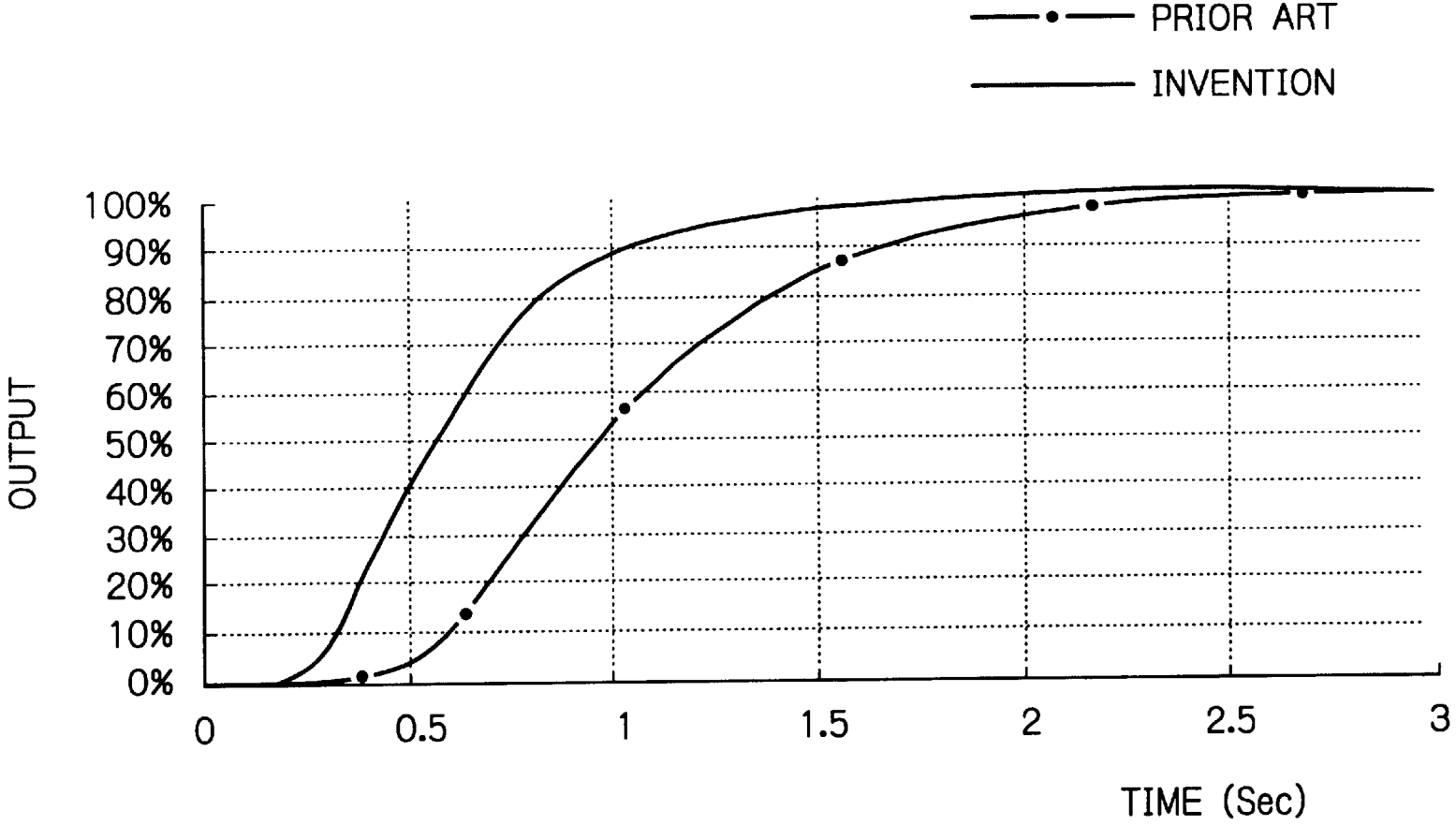
FIG. 16 is a graph comparing a halogen heater representative of an alternative embodiment of the present invention and a conventional halogen heater with respect to warm-up characteristic.

FIG. 16 shows experimental data comparing the warm-up characteristic of the halogen heater 23 of the illustrative embodiment and that of a conventional halogen heater. As shown, it takes about 1.7 seconds for the conventional halogen heater to be warmed up to 90% of its output. By contrast, the halogen heater 23 reaches 90% of its output in only 1 second. This suggests that the filament reduced in diameter and therefore in thermal capacity attains an improved warm-up characteristic. For given voltage and power, reducing the diameter of the filament is equivalent to raising the color temperature of the halogen heater.

Figure 17:
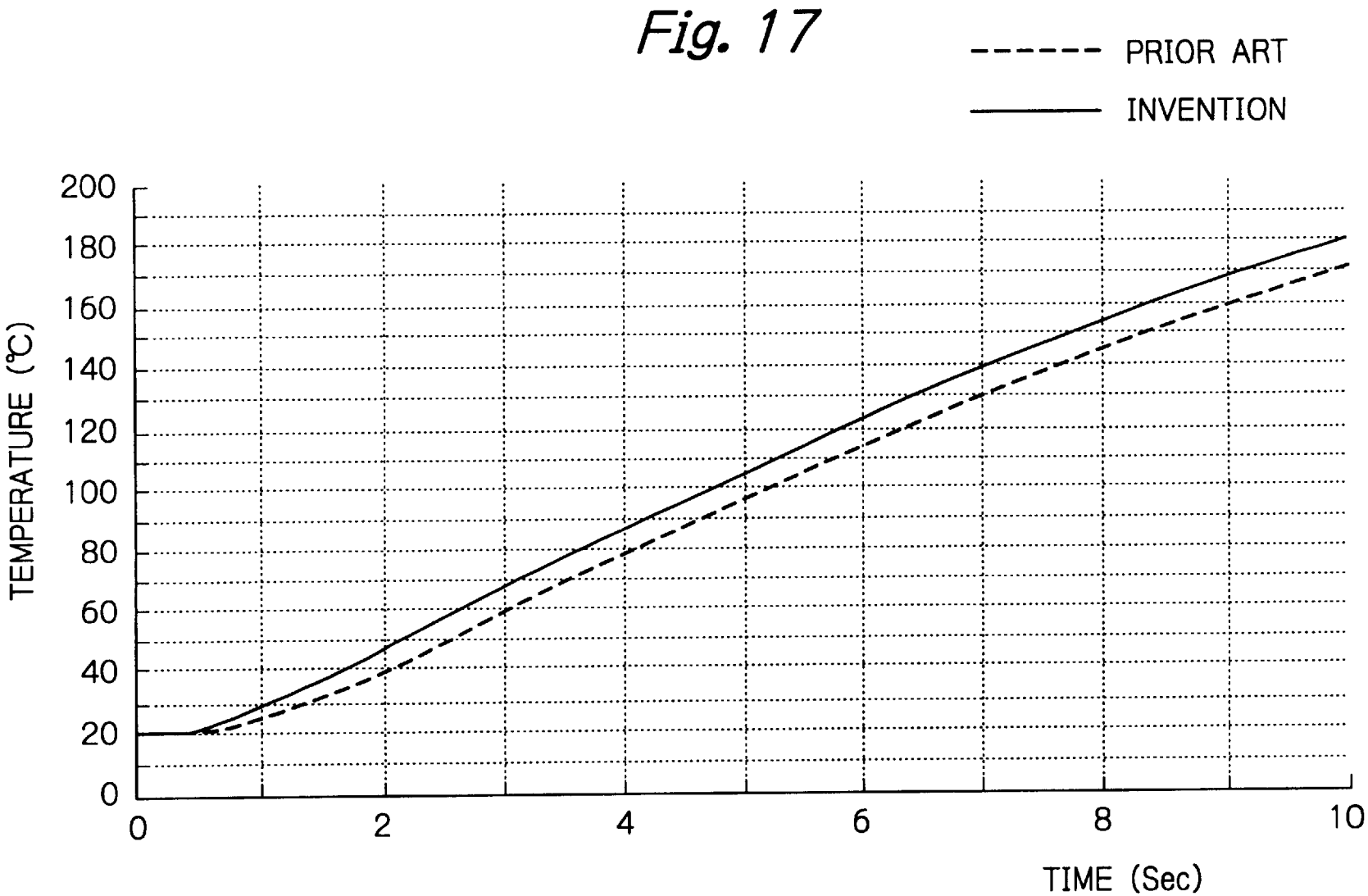
FIG. 17 is a graph comparing the embodiment of FIG. 16 and the conventional configuration as to the warm-up characteristic of the heat roller.

FIG. 17 shows experimental data comparing the warm-up of the heat roller 18 of the halogen heater 23 and that of a heat roller included in the conventional halogen heater. As shown, the heat roller 18 is warmed up more rapidly than the conventional heat roller.

Figure 18:
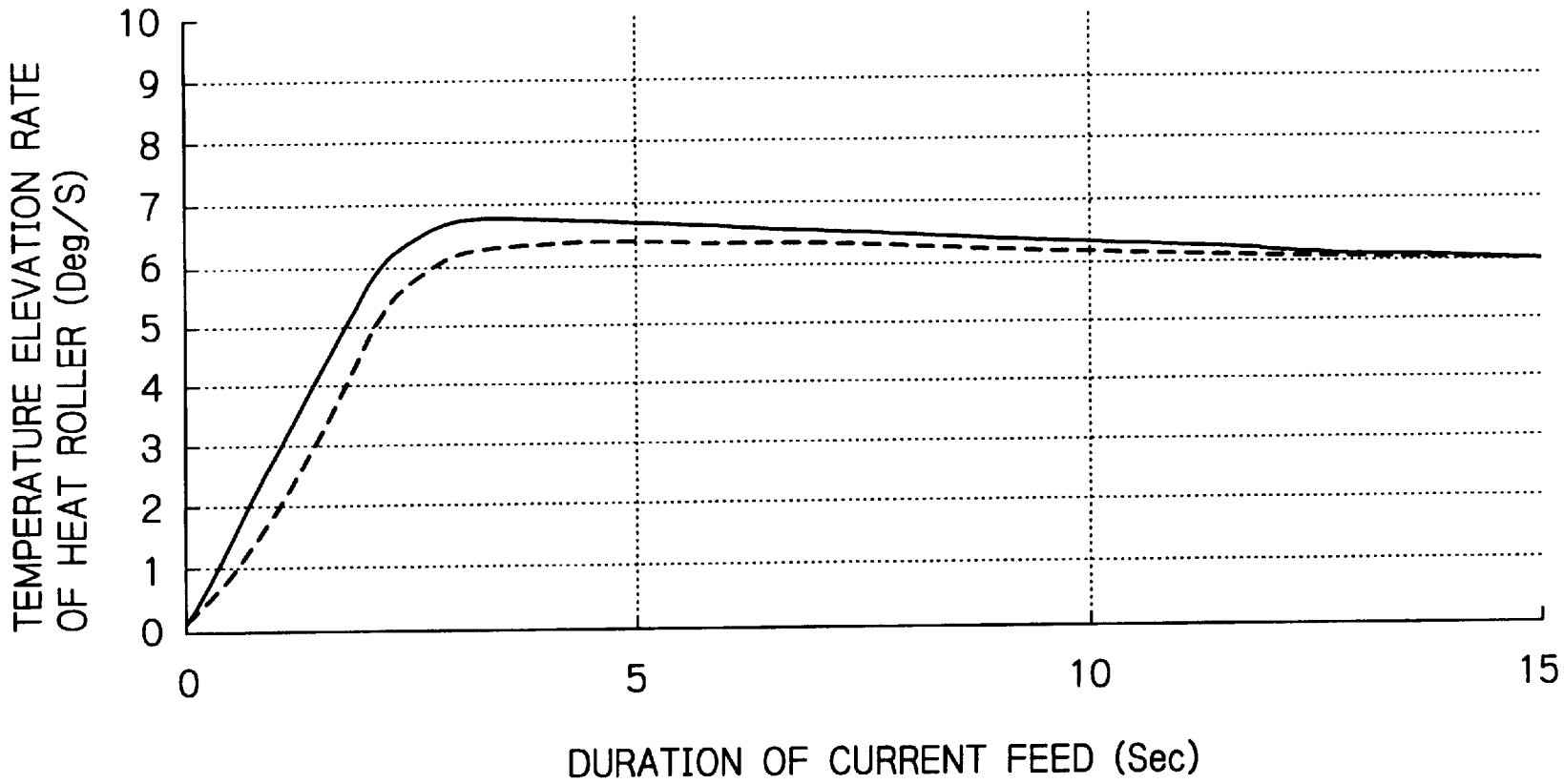
FIG. 18 is a graph comparing the embodiment of FIG. 16 and the conventional configuration with respect to the initial stage of warm-up.

FIG. 18 shows the temperature elevation rate of the heat roller 18 and that of the conventional heat roller of FIG. 17 by indicating the a slope of the curve on the ordinate in order to clear up a difference at the initial stage. As shown at the initial stage, the temperature of the halogen heater 23 rises at a higher rate than the conventional halogen heater and reaches substantially the same rate in about 10 seconds. This indicates that the halogen heater 23 with the filament reduced in diameter and raised In color temperature exhibits a desirable warm-up characteristic in a fixing device whose warm-up time is as short as about 10 seconds. Stated another way, such a halogen heater 23 is not so effective in a fixing device whose warm-up time is longer than 10 seconds.

As stated above, in the illustrative embodiment, the diameter of the conventional filament for a 2,400 K application is reduced by about 15% in order to implement a color temperature of 2,500 K or above. Such a diameter reduction ratio is related to inactive gas confined in the glass tube 28 of the halogen heater 23 as well. The heat loss occurring in the glass tube 28 is the combination of a loss ascribable to the temperature elevation of the glass tube 28 itself and a loss ascribable to the convection of the gas confined in the tube 28. While argon has customarily been confined in the glass tube 28 as inactive gas, the illustrative embodiment fills the glass tube 28 with krypton in order to reduce the loss ascribable to convection.

Figure 19:
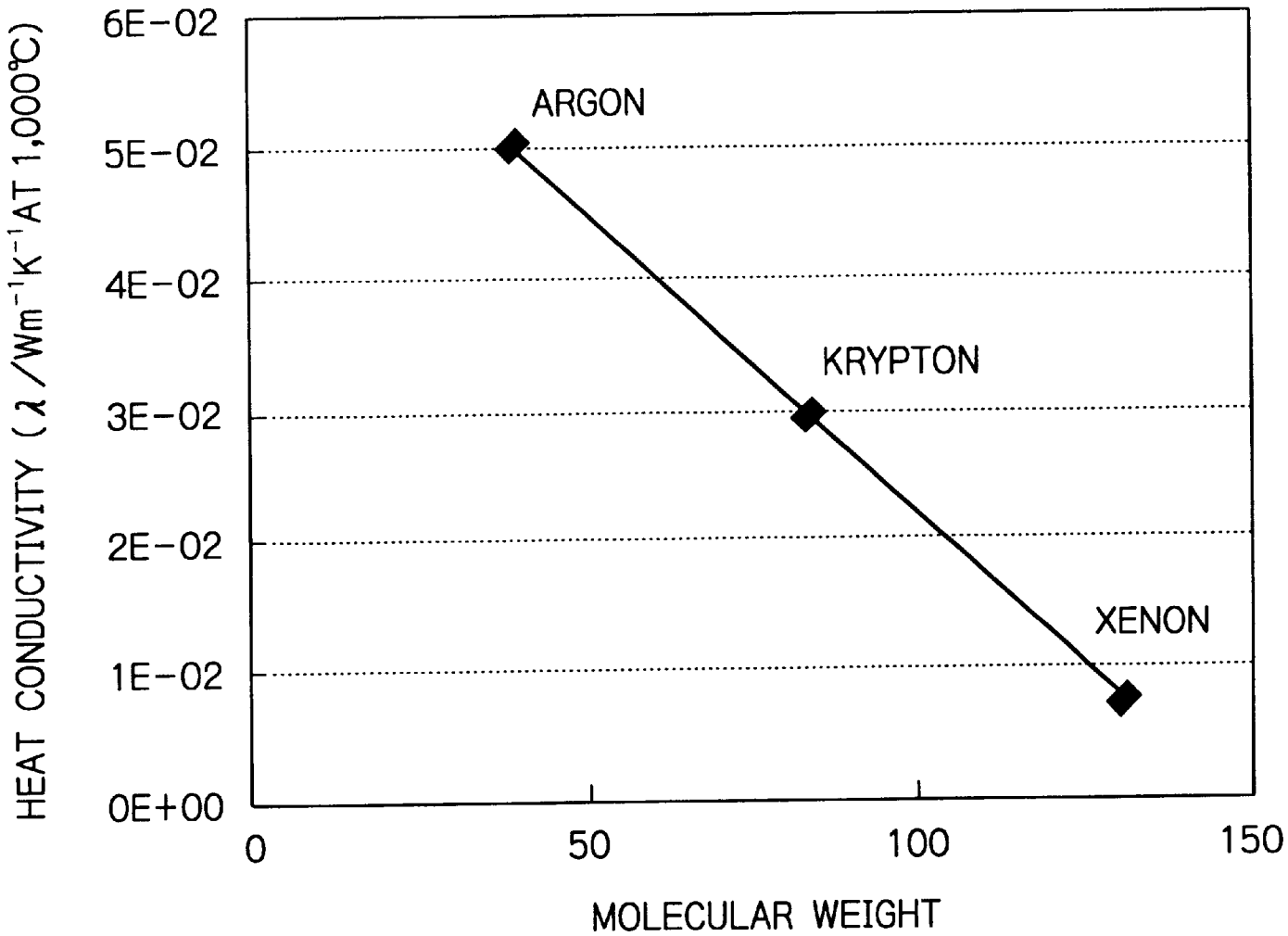
FIG. 19 is a graph showing the heat conductivity of inactive gases.

FIG. 19 is a graph comparing argon, krypton and xenon, which my be confined in the glass tube 28, with respect to heat conductivity. As shown, krypton is lower in heat conductivity than argon and therefore sparingly cools the mission from the tungsten filament 29, raising the color temperature accordingly. Also, by confining inactive gas whose major rent is krypton in the glass tube 28, it is possible to reduce the losses ascribable to the glass tube 28 and gas so as to increase the ratio of radiation to a member to be heated, thereby improving the warm-up characteristic.

To reduce the loss ascribable to the convection of the inactive gas, a particular kind of inactive gas may be selected from the molecular weight standpoint. A heavier molecular weight reduces the above loss and enhances the emission efficiency of the tungsten filament 29 more positively and thereby realizes faster warm-up. Gas with a heavy molecular weight can have its convection controlled, and in addition suppresses the vaporization of the tungsten filament 29 (as taught in "Illumination Handbook", Ohm Publishing Co., Ltd, p. 157 and Japanese Patent Laid-Open Publication No. 7-65798). Such gas therefore contributes a great deal to the extension of the service life of the halogen heater 23.

FIG. 20 shows the results of experiments conducted by varying the gas to be confined in the glass tube 28 and the color temperature of the tungsten filament 29. As shown, a halogen heater with a filament reduced in diameter and therefore raised in color temperature is shorter in life than a conventional halogen heater. However, even such a halogen heater achieves the same life as the conventional one and improves the warm-up characteristic when combined with gas having a heavy molecular weight.

FIG. 21 lists experimental data representative of temperature elevation times (warm up times) derived from various gases and various color temperature. As shown, a halogen heater with a a filament reduced in diameter and thermal capacity and raised in color temperature successfully reduces the temperature elevation time. Further, krypton (Kr) or xenon (Xe) used as inactive gas further reduces the temperature elevation time at levels below 10 seconds.

The diameter of the tungsten filament 29 of the halogen heater 23 increases with a decrease in resistance. The heater resistance tends to decrease, i.e., the diameter tends to increase when the voltage belongs to a 100 V class than when it belongs to a 200 V class for given rated power. That is, the thermal capacity of the filament tends to increase, extending the warm-up time of the filament itself. Therefore, the above-described advantage achievable with the high color temperature is more prominent in a halogen heater whose voltage is 120 V or below belonging to the 100 V class. In light of this, the illustrative embodiment applies a voltage of 120 V to the halogen heater 23.

Figure 22A:
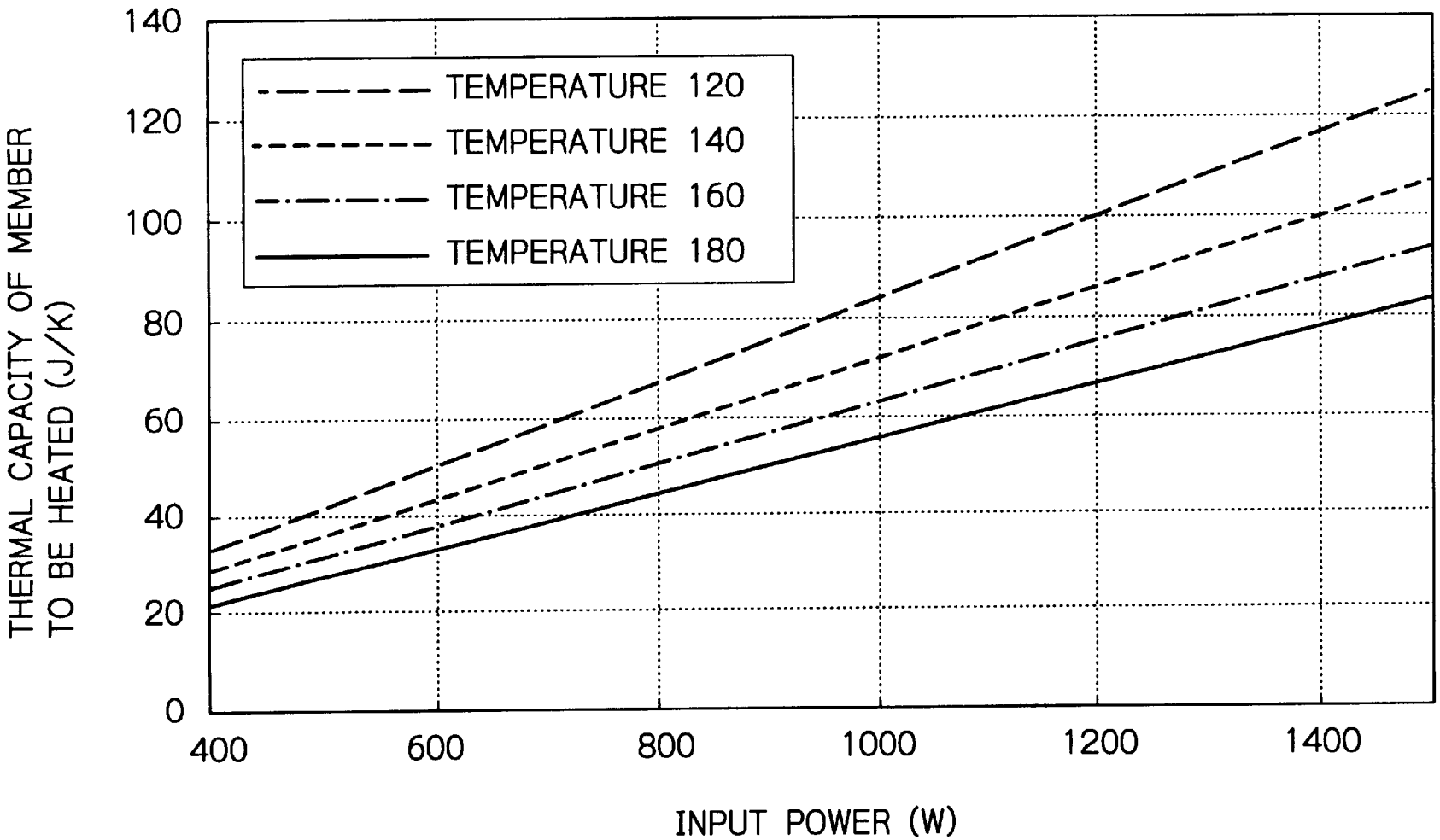
FIGS. 22A and 22B are graphs showing a relation between the thermal capacity of the heat roller and the warm-up time.
Figure 22B:
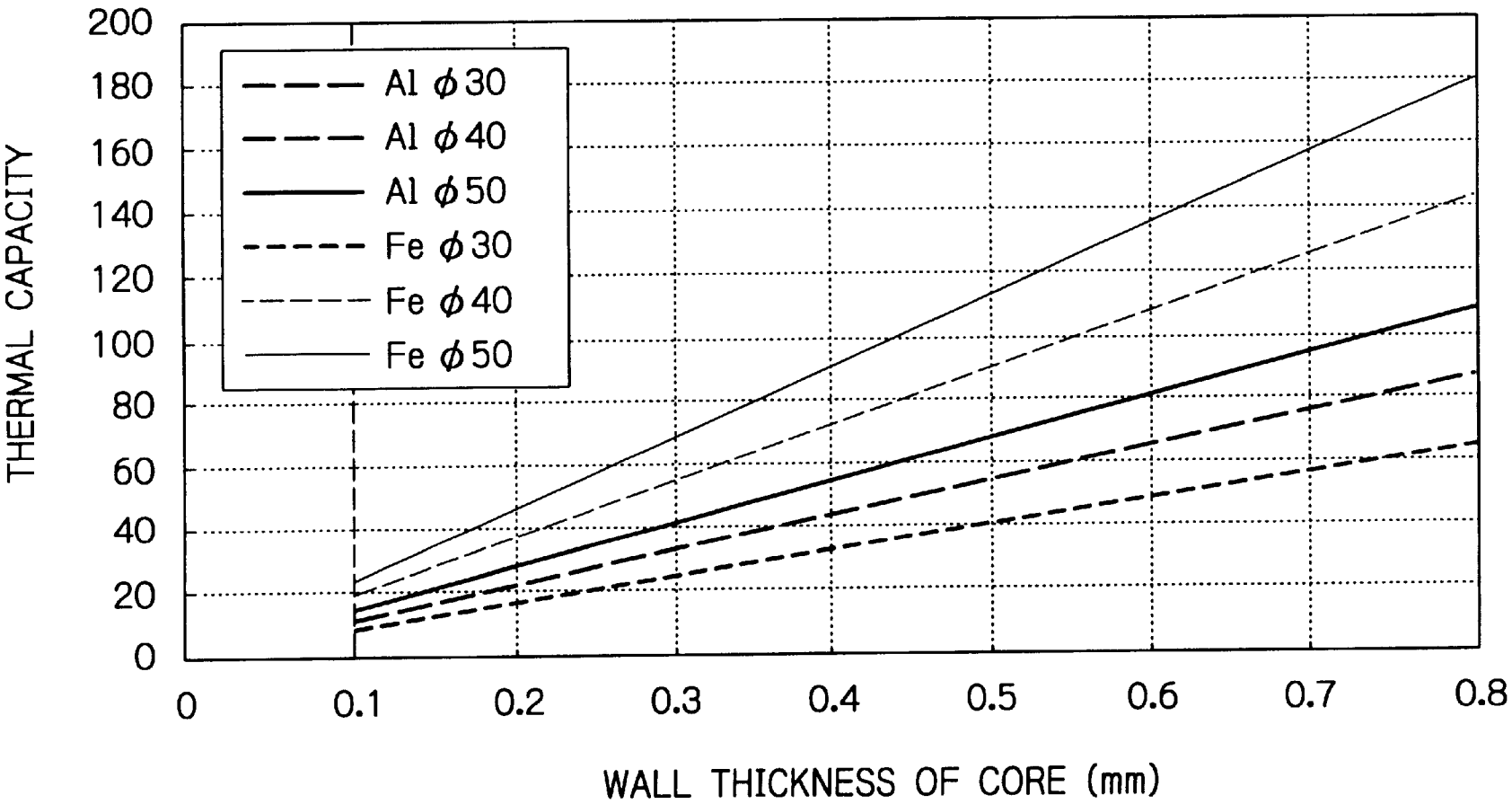

The temperature elevation time of the member to be heated (heat roller 18) is estimated on the basis of the thermal capacity (specific heat, density and volume) of the member, a set temperature, and power input to the halogen heater. As shown in FIGS. 22A and 22B, while configurations for heating the member to the set temperature in 10 seconds can be estimated by calculation, some different combinations are available.

The tungsten filament 28 reduced in diameter and therefore raised in color temperature exhibits its effect in a fixing device whose warm-up time is as short as about 10 seconds or less, as stated earlier. In the illustrative embodiment, there holds a relation:

$$\rho \times C \times V \times \Delta T / P \leqq 10$$

where ρ denotes the density of the member to be heated ($kg/m^3$), C denotes the specific heat of the member (J/kg/K), V denotes the volume of the member ($m^3$), ΔT denotes a difference in the temperature elevation of the member to the set temperature (K), and P denotes power input to the halogen heater (W).

Japanese Patent Laid-Open publication No. 11-174899 mentioned earlier vaguely describes that when the color temperature is 2,400 K or above, the emission efficiency (Lm/W) increases. By contrast, the illustrative embodiment reduces the diameter of the tungsten filament 29 in order to reduce the thermal capacity, thereby improving the warm-up characteristic, particularly in the range of up to 10 seconds. Moreover, the prerequisite with the above document is a constant voltage circuit.

The tungsten filament 29 with he color temperature of 2,500 K or above is shorter in turn-on life than the conventional one. However, because the turn-off time noticeably decreases In the energy saving type of fixing device that turns off the power supply in the stand state, the halogen heater with the filament 29 and the entire fixing device achieve a sufficient services life without resorting to a constant voltage circuit. Further, by combining such a halogen heater with the heat roller whose warm-up time is 10 seconds or less, an energy saving type of fixing device is achievable.

Moreover, inactive gas hiving a heavy molecular weight provides the fixing device with a life as long as conventional one despite that the diameter of the tungsten filament 29 is reduced in diameter in order to raise the color temperature.

Figure 23:
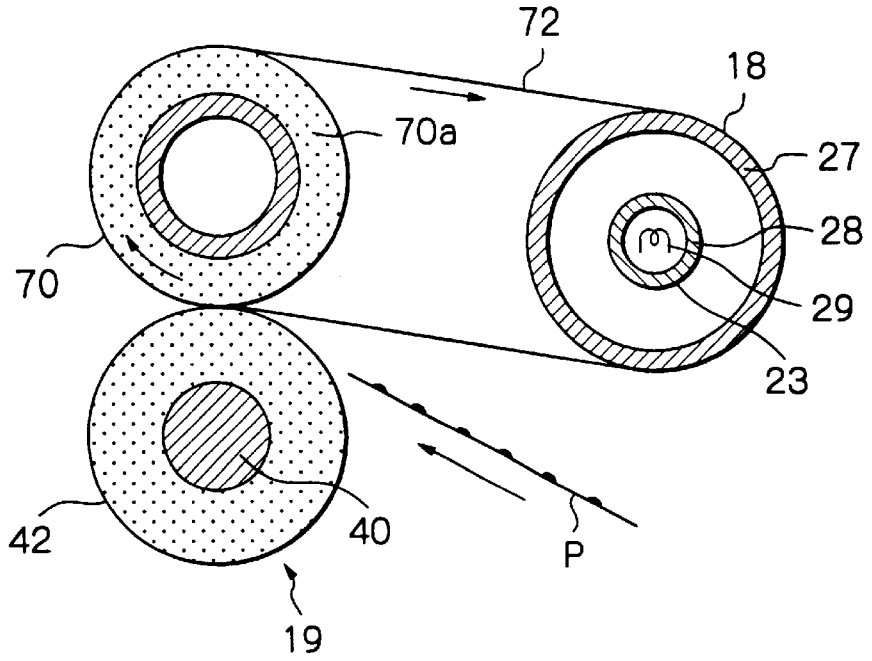
FIG. 23 is a front view showing a modified form of the fixing device.

FIG. 23 shows a belt type fixing device with which the present invention is also practicable. In the figures, identical reference numerals designate identical structural elements. As shown, an endless belt 72 is passed over the heat roller 18 and a fixing roller 70 Including an elastic layer 70*a*. The press roller 19 is pressed against the fixing roller 70 via the belt 72. The heat roller 18 heats the belt 72 so as to fix a toner image carried on a paper shoot P brought to the nip between the rollers 70 and 19. The fixing device achieves the same warm-up time as in the illustrative embodiment because of the warm-up characteristic of the heat roller 18. If desired, the halogen heater 23 may directly heat the belt 72 without the intermediary of the heat roller 18.

While the illustrative embodiment uses the halogen heater 23 as a radiation heat source, the heater 23 does not have to be filled with a halogen substance. The crux is that the heater 23 can heat the heat roller by radiation. Even if the heater 23 is not filled with a halogen substance, inactive gas whose major opponent is krypton or xenon is capable of reducing the heat loss ascribable to convection.

As stated above, the illustrative embodiment achieves various advantages, as enumerated below.

(1) A member to be heated reaches a set temperature within 10 seconds (warm-up time) while a radiation heat source has a color temperature of 2.500 K or above. This accelerates the warm-up of the radiation heat source and thereby further reduces the warm-up time of the member to be heated, improving manipulability and enhancing energy saving. For example, when the temperature elevation is faster than one available with a conventional radiation heat source by 10%, the member to be heated (heat roller) can have its wall thickness increased by 10% for achieving the same warm-up time. Such a wall thickness improves the durability of the heat roller and reduces the cost. Further, to attain the above warm-up time, power to be input can be reduced by 10%. This successfully reduces the power consumption of a fixing device and thereby saves energy. Moreover, because the radiation heat source itself warms up rapidly, it responds more sharply than the conventional halogen heater at the time of turn-on and turnoff in a steady state. Consequently, there can be reduced the temperature ripple of the member to be heated (heat roller) when a paper arrives at the member. In addition, the radiation heat source featuring the short warm-up time reduces the duration of rush current, which flows when a power source is turned on, and therefore suffers from a minimum of influence of electric noise.

(2) In a fixing device whose warm-up time is 10 seconds or less, the radiation heat source is provided with a color temperature of 2,500 K or above and applied with a rated voltage of 120 V or below. In this condition, the warm-up characteristic of the radiation heat source is effectively attainable. This further reduces the warm-up time to a set temperature, further improves manipulability, and further promotes energy saving. In addition, the various effects described in relation to the above advantage (1) are achieved.

(3) In the illustrative embodiment, there holds a relation:

$$\rho \times C \times V \times \Delta T / P \leqq 10$$

where ρ denotes the density of the member to be heated ($kg/m^3$), C denotes the specific heat of the member (J/kg/K). V denotes the volume of the member ($m^3$), ΔT denotes a difference in the temperature elevation of the member to the set temperature (K), and P denotes power input to the halogen heater (W). This coupled with the color temperature of 2,500 K or above, allows the warm-up characteristic of the radiation heat source to be effectively attained, further improves manipulability, and further saves energy. In addition, the various effects described in relation to the above advantage (1) are achieved.

(4) There can be reduced a heat loss ascribable to the convection of inactive gas filled in the radiation heat source, so that the emission efficiency of the heat source is enhanced. Such a heat source, when combined with inactive gas having a heavy molecular weight, suppresses the vaporization of a tungsten filament and thereby enhances durability.

Third Embodiment

In another alternative embodiment to be described, the inactive gas is implemented by gas whose major component is krypton. Generally, a glass tube and gas confined therein absorb about one-fourth of radiation from a filament, resulting in a heat loss that slows down warm-up. The illustrative embodiment pays attention to and improves a heat loss relating to heat transfer that is ascribable to the convection of the gas in the glass tube. Specifically, the illustrative embodiment suppresses heat migration in the glass tube 28 due to the inactive gas so as to reduce the heat loss in the glass tube 28 as far as possible.

Figure 24:
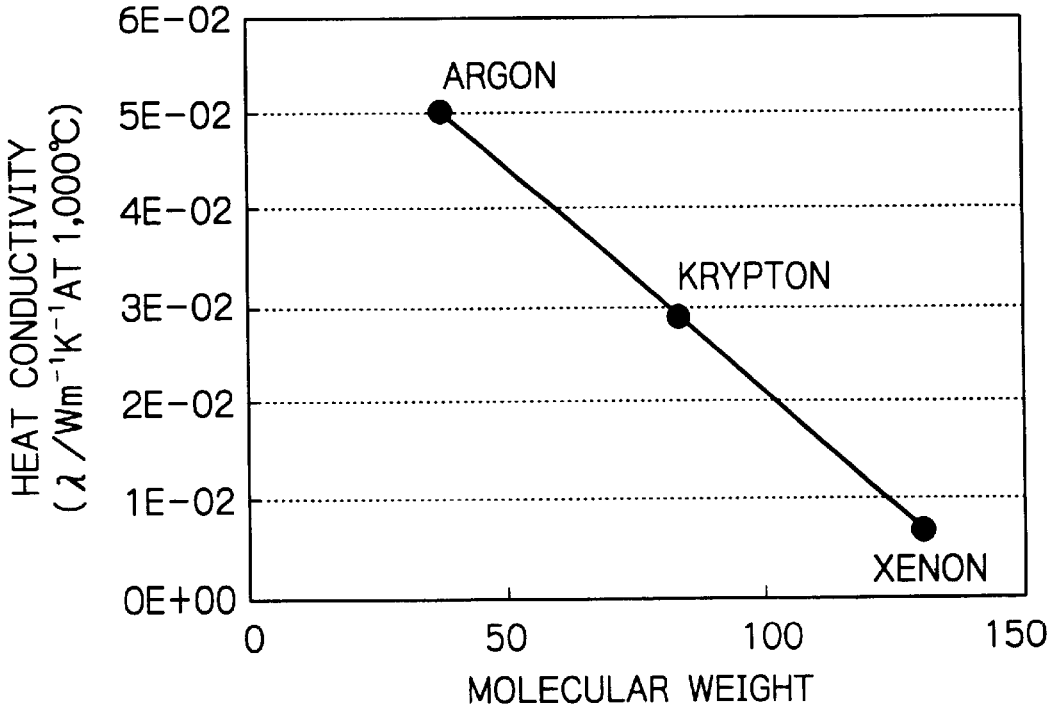
FIG. 24 is a graph showing the heat conductivity of inactive gases.

FIG. 24 compares argon, krypton and xenon, which are specific inactive gases, with respect to heat conductivity. As shown, krypton is lower in heat conductivity than argon, but higher in heat conductivity than xenon. Stated another way, krypton is higher in molecular weight than argon, but smaller in molecular weight than xenon. While nitrogen or argon has customarily been used with a radiation heater, krypton or xenon lower in heat conductivity than argon is capable of reducing an energy loss ascribable to heat conduction to occur in.the glass tube 28.

A heat loss ascribable to convection is the product of a temperature difference between a filament and the inner surface of a glass tube, a loss length, Nu (Nusselt number), and the heat conductivity of gas confined in the glass tube. Quantitative discussion is difficult because the temperature of the inner surface of the glass tube cannot be accurately measured, causing Nu to vary in accordance with the temperature and the kind of gas. However, by using differences in thermal conductivity shown in FIG. 24, it is possible to definitely and easily select gas capable of reducing the heat loss ascribable to convection.

To reduce the loss ascribable to convection in the glass tube 28, inactive gas may be selected from the molecular weight standpoint. Gas with a heavy molecular weight can have its convection control led, and in addition suppresses the vaporization of the tungsten filament, as stated previously. Such gas therefore contributes a great deal to the extension of the life of the halogen heater.

FIG. 25 shows the results of experiments conducted by varying the gas to be confined in the glass tube 28 and the color temperature of the tungsten filament 29. As Experiments 1, 4 and 7 shown in FIG. 25 indicate, the shorter warm-up time to the fixing temperature is reduced by krypton, which is lower in heat conductivity or higher in molecular weight than argon, and further reduced by xenon lower sin heat conductivity or higher in molecular weight than krypton.

Figure 26:
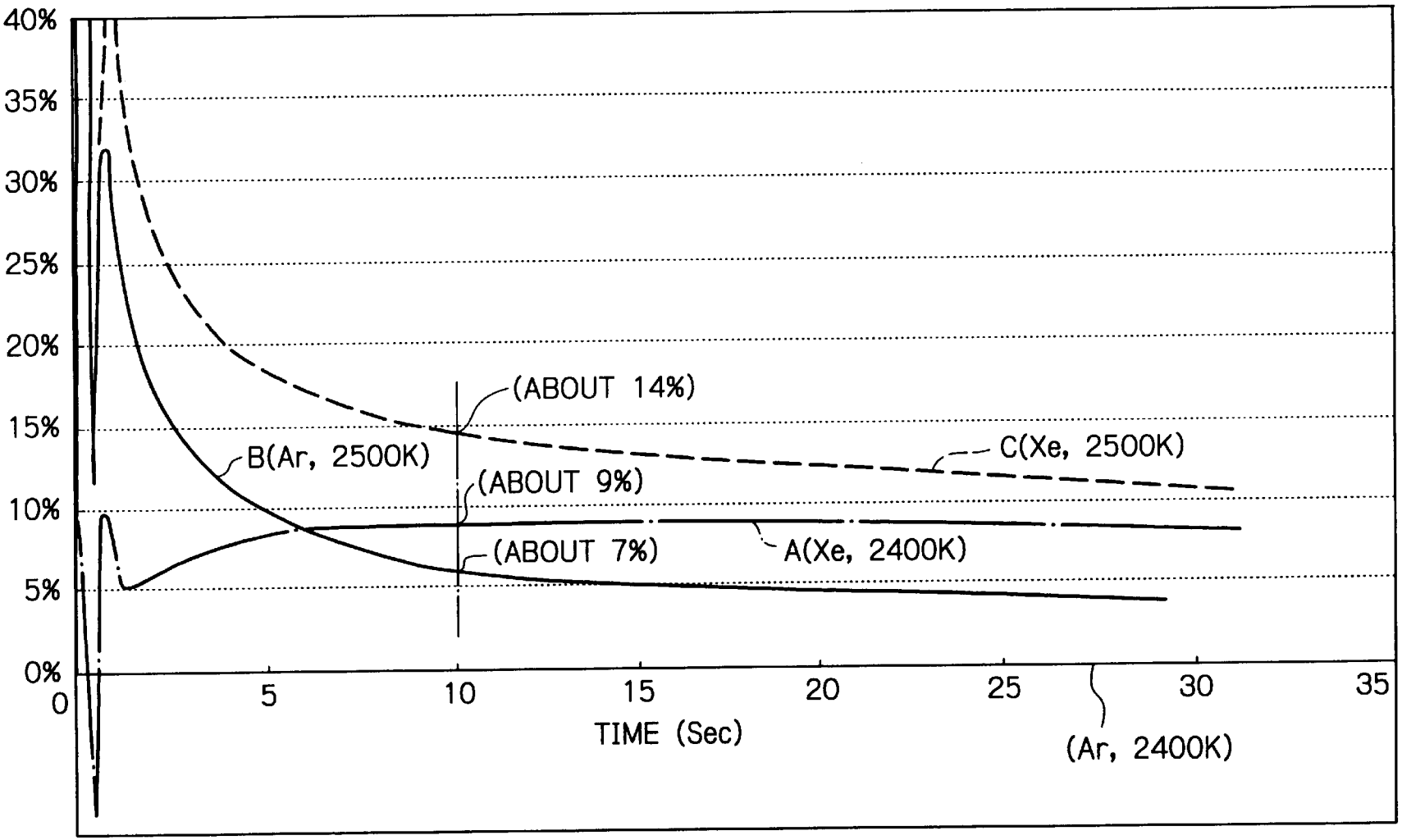
FIG. 26 is a graph representative of the degree of superiority as to the elevation to a preselected temperature in relation to a conventional fixing device.

FIG. 26 compares a conventional heat roller accommodating a radiation heater filled with argon (Ar) and a heat roller accommodating a radiation heater of the illustrative embodiment with respect to warm-up time. Assume that the heat roller with the conventional radiation heater reaches a given temperature in t seconds, and that heat roller of the illustrative embodiment reaches the same temperature in t' seconds. Then, the degree of superiority η (%) is expressed as:

$$\eta=(t-t')/t$$

In FIG. 26, a 0% line indicates the conventional heat roller filled with argon and having a filament whose color temperature is 2,400 K. A curve A indicates the heat roller of the illustrative embodiment, which is filled with inactive gas whose major component is xenon (Xe) and includes a filament whose color temperature is 2,400 K. As the curve A indicates, the heat roller of the illustrative embodiment has a degree of superiority of about 9% to the conventional heat roller in 10 seconds. The illustrative embodiment therefore reduces the warm-up time by 9%, compared to the conventional heat roller. Curves B and C shown in FIG. 26 will be described specifically later. The experimental data shown in FIG. 28 ware obtained with a glass tube having a diameter of 8 mm, input power of 100 V and 1,200 V, and a heat roller having a diameter of 50 mm and a thickness of 0.6 mm.

The illustrative embodiment is directed toward the acceleration of the warm-up of the radiation heater 23 itself. For this purpose, the diameter of the tungsten filament 29 is reduced in order to implement a color temperature that allows the heat roller 18 to reach the fixing temperature in 10 seconds or less. Specifically, the color temperature of the tungsten filament 29 is selected to be 2,500 K or above.

A color temperature refers to the temperature of a perfect radiator radiating light of the saw color as light radiated from a given radiator and. When the rated power and voltage of the radiation heater 23 are determined, resistance is automatically determined, so that the diameter and length of the tungsten filament 29 are adjusted. Resistance is proportional to the length of the tungsten filament 29, but inversely proportional to the cross-section of the same. Therefore, if the tungsten filament 29 has a diameter of 80%, a heater having the same resistance can be produced with the length of 64% (=0.8^2) and the thermal capacity (=volume) of 40.96% (=0.8^4). It follows that the diameter of 80% reduces the period of time necessary for the filament to reach the same temperature with the same amount of heat to about 40%.

The length of the filament decreases with an increase in the diameter of the same. However, because the total amount of heat generated is the same if resistance remains the same, the amount of heat generated for a unit length and color temperature increase as the diameter decreases. For given input power, when the diameter of the tungsten filament 29 is reduced to reduce the thermal capacity, the color temperature of the filament 29 rises. This, coupled with the fact that the vaporization of the tungsten filament 29 is accelerated, reduces the life of the filament 29. In light of this, the center value of the color temperature has heretofore been confined in the range of from 2,200 K to 2,400 K with importance attached to the service life.

As FIG. 25 indicates, the temperature elevation time can be reduced if use is made of the radiation heat source whose filament has a reduced diameter and therefore a reduced thermal capacity and a raised color temperature. As the curve B shown in FIG. 26 indicates, when the color temperature is 2,500 K a degree of superiority of about 7% to the conventional warm-up time is achieved.

The illustrative embodiment uses inactive gas whose major component is krypton or xenon higher in molecular weight than argon, as stated above. This is successful to further reduce the warm-up time, as seen from Experiments 5, 6, 8 and 9 shown in FIG. 25. This advantage is also proved by the curve C of FIG. 26; a degree of superiority of about 14% is attained.

Further, the inactive gas having a heavy molecular weight suppresses the vaporization of the tungsten filament 29. Therefore, as the column "Continuous Turn-On Life" of FIG. 25 indicates, it is possible to reduce the warm-up time while maintaining a service life comparable with conventional one.

In the illustrative embodiment the tungsten filament 29 includes segment portions whose ratio to the entire filament 29, i.e., an omitting portion is 50% or above. Specifically, as shown in FIG. 27, the tungsten filament 29 is made up of segment portions 29*a* densely wound and reaching the preselected color temperature and linear or loosely wound lead portions 29*b*. Generally, stresses ascribable to a heat cycle relating to the turn-on and turn-off of the power source act on the tungsten filament 29 as a result of expansion and contraction. Therefore, when the diameter of the tungsten filament 29 is reduced for raising the color temperature, the filament 29 is act to break at portions 29*c* that connect the segment portions 29*a* and lead portions 29*b*. The illustrative embodiment solves this problem by causing the segment portions 29*a*, which resemble coil-springs and have flexibility, to absorb the above stresses. For this purpose, the ratio of the segment portions 29*a* to the entire tungsten filter 29 is selected to be 50% or above.

When the diameter of the tungsten filament 29 is reduced to raise the color temperature, the length of the filament 29 decreases, as stated earlier. In the illustrative embodiment, the diameter or the pitch of the turns of the tungsten filament 29 is so adjusted as to make up for the decrease in length. In addition, the ratio of the segment portions 29*a* to the entire tungsten filter 29 is increased.

FIG. 28 shows experimental data derived from various ratios of the segment portions 29*a* to the entire tungsten filament 29. It is to be noted that a radiation heater does not withstand practical use unless its life is as long as about 3,000 hours when continuously turned on. As for the heat cycle, the radiation heater must endure about 100,000 times of repeated heat cycle. Experiments 10 through 15 shown in FIG. 28 show that when the ratio of the segment portions 29*a* is 50% or above, the tungsten filament surely attains the required heat cycle durability (100,000 times) despite its high color temperature. Such a service life is comparable with the conventional service life.

Moreover, the illustrative embodiment increases the ratio of the segment portions 29*a* by using the extension of the length of the tungsten filament 29 resulting from the reduced diameter. If the diameter of the tungsten filament 29 is not reduced, but the input power is increased in order to raise the color temperature, then the diameter of the turns of the segment portions 29*a* may be reduced for increasing the above ratio.

In addition, in the illustrative embodiment, the segment portions 29*a* are distributed substantially evenly over the entire emitting portion This obviates irregular heating in the axial direction of the heat roller 10.

Figures 29, 30:
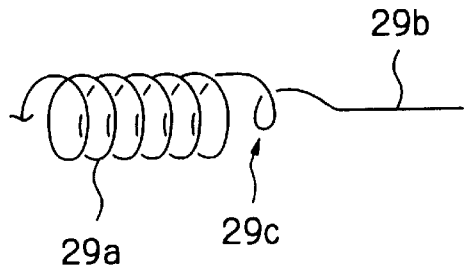
FIG. 29 is a view showing a modified configuration of the filament.
FIG. 30 is stable listing the results of experiments conducted with the filament configuration shown in FIG. 29.

FIG. 29 shows another specific configuration for absorbing the stresses ascribable to the repeated heat cycle. As shown, each connecting portion 29*c* of the tungsten filament 29 is sequentially reduced in the density of turns from the segment portion 29*a* toward the lead portion 29*b*. This kind of configuration also effectively absorbs the stresses ascribable to the repeated heat cycle. FIG. 30 shows the results of experiments conductive with the configuration shown in FIG. 29. By comparing, e.g., Experiment 16 of FIG. 30 and Experiment of FIG. 25, it will be seen that the tungsten filament 29 with the configuration of FIG. 29 surely attains the required heat cycle durability (100,000 times) even if the ratio of the segment portions 29*a* is the same as the conventional ratio.

The illustrative embodiment, like the second embodiment, is similarly practicable with the belt type fixing device described with reference to FIG. 25.

In the illustrative embodiment, the diameter of the tungsten filament 29 is reduced for implementing the color temperature of 2,500 K or above. Alternatively, if only the fast warm-up of the radiation heater 23 itself is desired, the input power may be increased for the same purpose.

As stated above, the illustrative embodiment achieves various advantages, as enumerated below.

(1) Inactive gas confined in the glass tube 28 consists mainly of xenon or krypton in order to reduce the heat loss ascribable to convection. Therefore, when the fixing device is warmed up, the tungsten filament 29 is prevented from being cooled off by the gas ant promotes rapid warm-up. At the same time, the vapor pressure of the filament is low enough to realize a life longer than the conventional life. For example, when the temperature elevation is faster than one available with a conventional radiation heat source by 10% the member to be heated (heat roller) can have its wall thickness increased by 10% for achieving the same warm-up time. Such a wall thickness improves the durability of the heat roller and reduces the cost. Further, to attain the above warm-up time, power to be input can be reduced by 10%. This successfully reduces the power consumption of a fixing device and thereby saves energy.

(2) Because the radiation heat source or halogen heater itself is rapidly warmed up, it responds more sharply to the turn-on and turn-off of the power source than the conventional halogen heater. This improves the temperature ripple of the member to be heated (heat roller) when a paper sheet arrives at the heat roller.

(3) The radiation heat source featuring the short warm-up time reduces the duration of rush current, which flows when a power source is turned on, and therefore suffers from a minimum of influence of electric noise.

(4) The color temperature of the tungsten filament is high enough to promote the fast warm-up of the filament and therefore the fast warm-up of the entire fixing device.

(5) Because the high color temperature is implemented by reducing the diameter of the tungsten filament, the fast warm-up of the fixing device is achievable without increasing input energy.

(6) The ratio of the segment portions of the tungsten filament to the entire filament is selected to be 50%. The segment portions therefore absorb the expansion and contraction of the filament during heat cycle, so that a life as long as conventional one is attained despite the fast warm-up derived from the high color temperature.

(7) The segment portions are distributed substantially evenly over the emitting portion, obviating irregular heating in the axial direction of the heat roller.

(8) The portions connecting the segment portions and lead portions each are so configured as to easily absorb stresses ascribable to the heat cycle. This allows the expansion and contraction of the tungsten filament to be absorbed without increasing the ratio of the segment portions.

Various modifications will become possible for those skilled in the art after receiving the teachings of the present disclosure without departing from the scope thereof.

What is claimed is:

1. A fixing device comprising:

a heat roller having a base implemented by a metallic pipe having a wall thickness of 0.8 mm or below and accommodating a radiation heater which comprises a glass tube filled with inactive gas and a halogen substance; and a press member pressed against said heat roller, wherein said glass tube has a mean transmission of 94% or above with respect to light having a wavelength of 300 nm to 3,000 nm.

2. A fixing device as claimed in claim 1, wherein said glass tube comprises transparent quartz made from crystal.

3. A fixing device comprising:

a heat roller having a base implemented by a metallic pipe having a wall thickness of 0.8 mm or below and accommodating a radiation heater which comprises a glass tube filled with inactive gas and a halogen substance; and a press member pressed against said heat roller, wherein said glass tube has a wall thickness of 0.8 mm or below.

4. A fixing device as claimed in claim 3, said press member comprises a press roller formed of a foam material.

5. A fixing device as claimed in claim 4, wherein said radiation heater is supported via a heat resistance, shock absorbing material configured to absorb shocks and vibrations.

6. In an image forming apparatus including a fixing device, said fixing device comprising:

a heat roller having a base implemented by a metallic pipe including a wall thickness of 0.8 mm or below and accommodating a radiation heater which comprises a glass tube filled with inactive gas and a halogen substance; and a press member pressed against said heat roller, wherein said glass tube has a mean transmission of 94% or above with respect to light having a wavelength of 300 nm to 3,000 nm.

7. An apparatus as claimed in claim 6, wherein said press member comprises a press roller formed by a foam material.

8. An apparatus as claimed in claim 7, wherein said radiation heater is supported via a heat resistant, shock absorbing member configured to absorb shocks and vibrations.

9. An apparatus as claimed in claim 8, wherein said radiation heater is turned on in a stand-by state of said apparatus.

10. A fixing device as claimed in claim 9, wherein said press member comprises a press roller formed of a foam material.

11. A fixing device as claimed in claim 10, wherein said radiation heater is supported via a heat resistance, shock absorbing material configured to absorb shocks and vibrations.

12. In an image forming apparatus including a fixing device, said fixing device comprising:

a heat roller having a base implemented by a metallic pipe having a wall thickness of 0.8 mm or below and accommodating a radiation heater which comprises a glass tube filled with inactive gas and a halogen substance; and a press member pressed against said heat roller, wherein said glass tube has a wall thickness of 0.8 mm or below.

13. An apparatus as claimed in claim 12, wherein said press member comprises a press roller formed of a foam material.

14. An apparatus as claimed in claim 13, wherein said radiation heater is supported via a heat resistant, shock absorbing member configured to absorb shocks and vibrations.

15. An apparatus as claimed in claim 14, wherein said radiation heater is configured to be turned on in a stand-by state of said apparatus.

16. In a radiation heater having a glass tube filled with inactive gas and a halogen substance for use with a fixing device, said fixing device comprising:

a heat roller provided with a base implemented by a metallic pipe having a wall thickness of 0.8 mm or above, and a press member pressed against said heat roller, said glass tube having a mean transmission of 94% or above with respect to light having a wavelength of 300 nm to 3,000 nm.

17. In a radiation heater having a glass tube filled with inactive gas and a halogen substance for use with a fixing device, said fixing device comprising:

a heat roller provided with a base implemented by a metallic pipe having a wall thickness of 0.8 mm or below; and a press member pressed against said heat roller, said glass tube having a wall thickness of 0.8 mm or below.

* * * * *